US010279996B2

(12) United States Patent
Yang et al.

(10) Patent No.: US 10,279,996 B2
(45) Date of Patent: May 7, 2019

(54) RECEPTACLE WITH LOW FRICTION AND LOW NOISE MOTION DAMPER FOR LID

(71) Applicant: simplehuman, LLC, Torrance, CA (US)

(72) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 13/621,726

(22) Filed: Sep. 17, 2012

(65) Prior Publication Data

US 2013/0098913 A1 Apr. 25, 2013

Related U.S. Application Data

(60) Provisional application No. 61/535,908, filed on Sep. 16, 2011.

(51) Int. Cl.
*B65F 1/06* (2006.01)
*B65F 1/08* (2006.01)
(Continued)

(52) U.S. Cl.
CPC ..... *B65F 1/1623* (2013.01); *B65F 1/06* (2013.01); *B65F 1/08* (2013.01); *B65F 1/163* (2013.01);
(Continued)

(58) Field of Classification Search
CPC ..... B65F 1/163; B65F 1/1623
(Continued)

(56) References Cited

U.S. PATENT DOCUMENTS 830,182 A 9/1906 Skov
1,426,211 A 8/1922 Pausin
(Continued)

FOREIGN PATENT DOCUMENTS

AU 622536 4/1992
AU 365296 11/2015
(Continued)

OTHER PUBLICATIONS

U.S. Appl. No. 11/438,839, U.S. Pat. No. 7,656,109.
(Continued)

*Primary Examiner* — Jeffrey R Allen
*Assistant Examiner* — Jennifer Castriotta
(74) *Attorney, Agent, or Firm* — Knobbe, Martens, Olson & Bear, LLP

(57) ABSTRACT

A receptacle having a lid can be provided with a pair of dampers configured to slow the movement of the lid from its open position toward its closed position. The dampers can be provided at opposite ends of a pedal connected to the receptacle body at opposite lateral positions relative to a side of the receptacle body. In some embodiments, the damper is configured to be high endurance and low noise. For example, the damper may comprise lubricants, such as a graphite powder. The damper may also comprise a mechanism, such as foam infused with graphite powder, to disperse the lubricant over time. The damper may also employ surface features or noise dampening features in its housings to prevent or reduce noise.

17 Claims, 14 Drawing Sheets

(51) Int. Cl.
*B65F 1/16* (2006.01)
*B65F 7/00* (2006.01)

(52) U.S. Cl.
CPC ..... *B65F 7/00* (2013.01); *B65F 2001/1661* (2013.01); *B65F 2250/11* (2013.01)

(58) Field of Classification Search
USPC ..... 220/264, 908
See application file for complete search history.

(56) References Cited

U.S. PATENT DOCUMENTS 1,461,253 A 7/1923 Owen
1,754,802 A 4/1930 Raster
1,820,555 A 8/1931 Buschman
1,891,651 A 12/1932 Padelford et al.
1,922,729 A 8/1933 Geibel
1,980,938 A 11/1934 Geibel
2,308,326 A 1/1943 Calcagno
D148,825 S 2/1948 Snider
2,457,274 A 12/1948 Rifken
2,759,625 A 8/1956 Ritter
2,796,309 A 6/1957 Taylor
2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,300,082 A 1/1967 Patterson
3,392,825 A 7/1968 Gale et al.
3,451,453 A 6/1969 Heck
3,654,534 A 4/1972 Fischer
3,800,503 A 4/1974 Maki
3,820,200 A 6/1974 Myers
3,825,150 A 7/1974 Taylor
3,825,215 A * 7/1974 Borglum ..... 248/147
3,886,425 A 5/1975 Weiss
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins, III et al.
4,785,964 A 11/1988 Miller et al.
4,792,039 A 12/1988 Dayton
4,794,973 A 1/1989 Perisic
4,813,592 A 3/1989 Stolzman
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,888,532 A 12/1989 Josson
4,892,223 A 1/1990 DeMent
4,892,224 A 1/1990 Graham
D307,344 S 4/1990 Massonnet
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,076,462 A 12/1991 Perrone
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
D331,097 S 11/1992 Sieren
5,170,904 A 12/1992 Neuhaus
5,174,462 A 12/1992 Hames
D332,852 S 1/1993 Delmerico
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A 7/1994 Feigleson
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
5,520,067 A 5/1996 Gaba
5,520,303 A 5/1996 Bernstein et al.
5,531,348 A 7/1996 Baker et al.
5,535,913 A 7/1996 Asbach et al.
5,558,254 A 9/1996 Anderson et al.
5,560,283 A * 10/1996 Hannig ..... F02F 3/10 92/208
5,584,412 A 12/1996 Wang
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.

(56) References Cited

U.S. PATENT DOCUMENTS 5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,770,935 A 6/1998 Smith et al.
5,799,909 A 9/1998 Ziegler
5,816,431 A 10/1998 Giannopoulos
5,816,640 A 10/1998 Nishimura
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
D412,552 S 8/1999 Burrows
5,961,105 A * 10/1999 Ehrnsberger et al. ..... 267/216
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,105,859 A 8/2000 Stafford
6,123,215 A 9/2000 Windle
D431,700 S 10/2000 Roudebush
6,126,031 A 10/2000 Reason
6,129,233 A 10/2000 Schiller
6,131,861 A 10/2000 Fortier, Jr. et al.
D435,951 S 1/2001 Yang et al.
6,209,744 B1 4/2001 Gill
6,211,637 B1 4/2001 Studer
6,234,339 B1 5/2001 Thomas
6,250,492 B1 6/2001 Verbeek
D445,980 S 7/2001 Tjugum
6,286,706 B1 9/2001 Tucker
6,328,320 B1 12/2001 Walski et al.
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
6,519,130 B1 2/2003 Breslow
6,557,716 B1 5/2003 Chan
D476,456 S 6/2003 Englert et al.
6,596,983 B2 7/2003 Brent
6,626,316 B2 9/2003 Yang
6,626,317 B2 9/2003 Pfiefer et al.
6,632,064 B1 * 10/2003 Walker et al. ..... 414/406
D481,846 S 11/2003 Lin
D482,169 S 11/2003 Lin
6,659,407 B2 12/2003 Asaro
6,681,950 B2 1/2004 Miller, Jr. et al.
D488,604 S 4/2004 Yang et al.
D488,903 S 4/2004 Yang et al.
D489,503 S 5/2004 Lin
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,812,655 B1 11/2004 Wang et al.
6,814,249 B2 11/2004 Lin
D499,450 S 12/2004 Goodman et al.
6,837,393 B1 1/2005 Kuo
6,857,538 B2 2/2005 Lin
6,859,005 B2 2/2005 Boliver
D503,021 S 3/2005 Yang et al.
6,866,826 B2 3/2005 Moore et al.
6,883,676 B2 4/2005 Lin
D507,090 S 7/2005 Yang et al.
6,920,994 B2 7/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 3/2006 Gruber et al.
7,044,323 B2 5/2006 Yang
D525,756 S 7/2006 Yang et al.
7,073,677 B2 7/2006 Richardson et al.
7,077,283 B2 7/2006 Yang et al.
7,080,750 B2 7/2006 Wein et al.
7,086,550 B2 8/2006 Yang et al.
D528,726 S 9/2006 Lin
7,121,421 B2 10/2006 Yang et al.
D531,499 S 11/2006 Zaidman
D535,799 S 1/2007 Epps
D535,800 S 1/2007 Yang et al.
7,163,591 B2 1/2007 Kim et al.
7,168,591 B1 1/2007 Miller
D537,223 S 2/2007 Lin
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al.
D542,995 S 5/2007 Lin
D543,673 S 5/2007 Yang et al.
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,319 S 10/2007 Gusdorf
D552,321 S 10/2007 Yang et al.
D552,823 S 10/2007 Yang et al.
D552,824 S 10/2007 Zimmerman
D552,825 S 10/2007 Yang et al.
D555,320 S 11/2007 Yang et al.
D559,494 S 1/2008 Yang et al.
D559,495 S 1/2008 Yang et al.
D562,522 S 2/2008 Daams
7,328,842 B2 2/2008 Wagner et al.
D564,169 S 3/2008 Wang
D564,723 S 3/2008 Yang et al.
D566,367 S 4/2008 Lin
D566,369 S 4/2008 Shek
D566,923 S 4/2008 Lin
D567,468 S 4/2008 Yang et al.
D568,572 S 5/2008 Yang et al.
D569,720 S 5/2008 Lablaine
7,374,060 B2 5/2008 Yang et al.
D571,520 S 6/2008 Lin
7,395,990 B1 7/2008 Stevens
7,398,913 B2 7/2008 McClure
7,404,499 B1 7/2008 Ramsey
D574,569 S 8/2008 Yang et al.
D576,371 S 9/2008 Zimmerman
D578,265 S 10/2008 Presnell
D578,266 S 10/2008 Yang et al.
D578,268 S 10/2008 Yang et al.
D578,722 S 10/2008 Yang et al.

(56) References Cited

U.S. PATENT DOCUMENTS 7,438,199 B1 10/2008 Tidrick
D580,120 S 11/2008 Lin
D580,613 S 11/2008 Yang et al.
D580,615 S 11/2008 Yang et al.
D581,622 S 11/2008 Presnell et al.
D584,470 S 1/2009 Bizzell et al.
D585,171 S 1/2009 Bizzell et al.
D585,618 S 1/2009 Yang et al.
D586,070 S 2/2009 Lin
7,494,021 B2 2/2009 Yang et al.
D587,874 S 3/2009 Lin
D593,271 S 5/2009 Yang et al.
7,530,578 B2 5/2009 Niemeyer et al.
7,540,396 B2 6/2009 Yang et al.
7,543,716 B2 6/2009 Lin
7,559,433 B2 7/2009 Yang et al.
D599,074 S 8/2009 Bizzell et al.
D603,119 S 10/2009 Yang et al.
7,607,552 B2 10/2009 Efstathiou
D604,472 S 11/2009 Blanks et al.
7,614,519 B2 11/2009 Krauth et al.
7,621,420 B2 11/2009 Bandoh et al.
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D630,404 S 1/2011 Yang et al.
D631,221 S 1/2011 Yang et al.
D632,039 S 2/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
D655,061 S 2/2012 Scaturro
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,418,869 B2 4/2013 Yang et al.
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,672,171 B2 3/2014 Wynn et al.
8,678,219 B1 3/2014 Wang et al.
8,686,676 B2 4/2014 Yang et al.
D704,406 S 5/2014 Kern
8,716,969 B2 5/2014 Yang et al.
8,720,728 B2 5/2014 Yang et al.
D709,662 S 7/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D715,575 S 10/2014 Williams et al.
D716,015 S 10/2014 van de Leest
8,851,316 B2 10/2014 Barrett et al.
8,872,459 B2 10/2014 Yang et al.
D725,860 S 3/2015 Spivey et al.
D725,861 S 3/2015 Yang et al.
D730,008 S 5/2015 Yang et al.
9,051,093 B2 6/2015 Yang et al.
D755,461 S 5/2016 Wall
D759,934 S 6/2016 Yang et al.
D762,037 S 7/2016 Chen
D765,937 S 9/2016 Chen
D766,998 S 9/2016 Kao et al.
9,434,538 B2 9/2016 Yang et al.
D770,121 S 10/2016 Chen
D771,344 S 11/2016 Yang et al.
D773,769 S 12/2016 Chen
9,573,759 B2 2/2017 Yang et al.
9,586,755 B1 3/2017 Yang et al.
D787,828 S 5/2017 Thoma et al.
D790,145 S 6/2017 Chen
D793,642 S 8/2017 Yang et al.
D798,016 S 9/2017 Yang et al.
D804,133 S 9/2017 Yang et al.
9,751,692 B2 9/2017 Yang et al.
9,790,025 B2 10/2017 Yang et al.
9,856,080 B2 1/2018 Yang et al.
2001/0002690 A1 6/2001 Rosky
2001/0020619 A1 9/2001 Pfeifer et al.
2001/0045512 A1 11/2001 Brent
2002/0066736 A1 6/2002 Pyles
2002/0092853 A1 7/2002 Wang
2002/0096523 A1 7/2002 Pyles
2002/0096524 A1 7/2002 Hardesty
2002/0104266 A1 8/2002 Ranaudo
2002/0116924 A1* 8/2002 Winkelmann ..... B60T 11/165 60/533
2003/0089719 A1 5/2003 Berger
2003/0102316 A1 6/2003 Forest
2003/0201265 A1 10/2003 Lin
2003/0205979 A1 11/2003 Papari et al.
2003/0230576 A1 12/2003 Lin
2004/0016756 A1 1/2004 Lin
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0129803 A1* 6/2005 Umeda ..... B24C 1/00 425/568
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.
2006/0138149 A1 6/2006 Tracy
2006/0163257 A1 7/2006 Golbert
2006/0175336 A1 8/2006 Wang
2006/0186121 A1 8/2006 Yang et al.
2006/0196874 A1 9/2006 Yang
2006/0237641 A1 10/2006 Moeller et al.
2006/0249510 A1 11/2006 Lin
2006/0278643 A1 12/2006 Chiou
2007/0012699 A1* 1/2007 Yang et al. ..... 220/264

(56) References Cited

U.S. PATENT DOCUMENTS

| | | | | |
|---|---|---|---|---|
| 2007/0112699 | A1 | 1/2007 | Yang et al. | |
| 2007/0034334 | A1 | 2/2007 | Ramsey et al. | |
| 2007/0045326 | A1 | 3/2007 | Tramontina et al. | |
| 2007/0090112 | A1 | 4/2007 | Kalman et al. | |
| 2007/0114847 | A1 | 5/2007 | Ichimaru et al. | |
| 2007/0181579 | A1 | 8/2007 | Kuo et al. | |
| 2007/0209846 | A1 | 9/2007 | Wilson | |
| 2007/0215622 | A1 | 9/2007 | Perez | |
| 2007/0241109 | A1 | 10/2007 | Lin | |
| 2007/0266637 | A1 | 11/2007 | McGowan | |
| 2007/0272691 | A1 | 11/2007 | Wang et al. | |
| 2007/0289972 | A1 | 12/2007 | Wynn et al. | |
| 2008/0011754 | A1 | 1/2008 | Ramsey | |
| 2008/0011910 | A1 | 1/2008 | Ramsey | |
| 2008/0041863 | A1 | 2/2008 | Forest | |
| 2008/0083756 | A1 | 4/2008 | Daniels | |
| 2008/0083757 | A1 | 4/2008 | Parker et al. | |
| 2008/0099274 | A1* | 5/2008 | Seel | 181/202 |
| 2008/0128428 | A1 | 6/2008 | Beckerman | |
| 2008/0164257 | A1* | 7/2008 | Boll et al. | 220/264 |
| 2008/0236275 | A1 | 10/2008 | Breed et al. | |
| 2008/0257889 | A1 | 10/2008 | Kovacevich et al. | |
| 2008/0257890 | A1 | 10/2008 | Kovacevich et al. | |
| 2008/0257891 | A1 | 10/2008 | Kovacevich et al. | |
| 2008/0264948 | A1 | 10/2008 | Kovacevich et al. | |
| 2008/0264950 | A1 | 10/2008 | Kovacevich et al. | |
| 2008/0272119 | A1 | 11/2008 | Efstathiou | |
| 2008/0272127 | A1 | 11/2008 | Kovacevich et al. | |
| 2009/0071959 | A1 | 3/2009 | Cheung | |
| 2009/0084788 | A1 | 4/2009 | Yang et al. | |
| 2009/0136341 | A1* | 5/2009 | Kenyon | 415/203 |
| 2009/0230131 | A1 | 9/2009 | McDuffie et al. | |
| 2009/0261105 | A1 | 10/2009 | Cunningham et al. | |
| 2009/0266836 | A1 | 10/2009 | Mobley | |
| 2010/0006572 | A1 | 1/2010 | Chiou | |
| 2010/0084235 | A1 | 4/2010 | Lu | |
| 2010/0096894 | A1* | 4/2010 | Fukai | 297/300.5 |
| 2010/0122985 | A1 | 5/2010 | Peters et al. | |
| 2010/0147865 | A1 | 6/2010 | Yang et al. | |
| 2010/0170904 | A1 | 7/2010 | Kalman et al. | |
| 2010/0224627 | A1 | 9/2010 | Yang et al. | |
| 2010/0237074 | A1 | 9/2010 | Yang et al. | |
| 2010/0252557 | A1 | 10/2010 | Clements | |
| 2010/0294769 | A1 | 11/2010 | Lee et al. | |
| 2011/0017735 | A1 | 1/2011 | Wang et al. | |
| 2011/0049149 | A1 | 3/2011 | Shih | |
| 2011/0056952 | A1 | 3/2011 | Borowski et al. | |
| 2011/0139781 | A1 | 6/2011 | Jin et al. | |
| 2011/0220655 | A1 | 9/2011 | Yang et al. | |
| 2011/0272409 | A1 | 11/2011 | Kasbohm | |
| 2012/0145932 | A1 | 6/2012 | Yao et al. | |
| 2012/0234849 | A1 | 9/2012 | Hughes et al. | |
| 2012/0261423 | A1 | 10/2012 | Zawrotny et al. | |
| 2013/0097809 | A1 | 4/2013 | Weber et al. | |
| 2013/0105487 | A1 | 5/2013 | Baik | |
| 2013/0233853 | A1 | 9/2013 | Yang et al. | |
| 2013/0233857 | A1 | 9/2013 | Yang et al. | |
| 2013/0240592 | A1 | 9/2013 | Woodruff | |
| 2013/0248532 | A1 | 9/2013 | Yang et al. | |
| 2013/0248535 | A1 | 9/2013 | Wolfe et al. | |
| 2013/0300119 | A1 | 11/2013 | Anzalon et al. | |
| 2014/0183193 | A1 | 7/2014 | Hammond et al. | |
| 2014/0238989 | A1 | 8/2014 | Wang et al. | |
| 2014/0246432 | A1 | 9/2014 | Yang et al. | |
| 2014/0246434 | A1 | 9/2014 | Yang et al. | |
| 2014/0305946 | A1 | 10/2014 | Han | |
| 2014/0345453 | A1* | 11/2014 | Oh et al. | 92/169.1 |
| 2015/0251849 | A1 | 9/2015 | Yang et al. | |
| 2015/0259139 | A1 | 9/2015 | Yang et al. | |
| 2015/0259140 | A1 | 9/2015 | Yang et al. | |
| 2015/0321841 | A1 | 11/2015 | Salas et al. | |
| 2017/0096299 | A1 | 4/2017 | Yang et al. | |
| 2017/0127669 | A1 | 5/2017 | Yang et al. | |
| 2017/0166167 | A1 | 6/2017 | Heller et al. | |
| 2017/0253429 | A1 | 9/2017 | Yang et al. | |
| 2018/0093827 | A1 | 4/2018 | Yang et al. | |
| 2018/0178978 | A1 | 6/2018 | Yang et al. | |

FOREIGN PATENT DOCUMENTS

| | | | |
|---|---|---|---|
| AU | 201614908 | | 11/2016 |
| AU | 201614909 | | 11/2016 |
| CA | 2182840 | | 9/1997 |
| CA | 2519295 | | 3/2007 |
| CA | 132181 | | 6/2010 |
| CA | 136938 | | 5/2011 |
| CA | 141819 | | 4/2012 |
| CA | 146601 | | 2/2013 |
| CA | 152797 | | 4/2014 |
| CA | 158595 | | 4/2015 |
| CA | 158685 | | 4/2015 |
| CA | 164264 | | 10/2016 |
| CA | 164265 | | 10/2016 |
| CA | 167073 | | 10/2016 |
| CA | 170360 | | 3/2017 |
| CA | 170399 | | 3/2017 |
| CA | 168936 | | 10/2017 |
| CN | 2075182 | U | 4/1991 |
| CN | 201105898 | Y | 8/2008 |
| CN | 201372076 | Y | 12/2009 |
| CN | 201447201 | U | 5/2010 |
| CN | 201512253 | U | 6/2010 |
| CN | 201597962 | U | 10/2010 |
| CN | 102190144 | A | 9/2011 |
| CN | 301947175 | S | 6/2012 |
| CN | 103207416 | A | 7/2013 |
| CN | 103300590 | A | 9/2013 |
| CN | 103381944 | A | 11/2013 |
| CN | 302771721 | S | 3/2014 |
| CN | 201330418089.X | | 3/2014 |
| CN | 104016030 | A | 9/2014 |
| CN | 303188855 | S | 4/2015 |
| CN | 303206241 | S | 5/2015 |
| CN | 303611394 | S | 3/2016 |
| CN | 303622098 | S | 3/2016 |
| CN | 205169479 | U | 4/2016 |
| CN | 303967208 | S | 12/2016 |
| CN | 304018339 | S | 1/2017 |
| CN | 304018340 | S | 1/2017 |
| CN | 103381944 | B | 3/2017 |
| CN | 201310076306.0 | | 12/2017 |
| CN | 201580000648.1 | | 1/2018 |
| CN | 201730168630.4 | | 2/2018 |
| DE | 1610087 | | 7/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| DE | 10337806 | A1 | 3/2005 |
| EP | 0582240 | | 7/1993 |
| EP | 0903305 | A1 | 3/1999 |
| EP | 0906876 | A2 | 4/1999 |
| EP | 1094017 | A1 | 4/2001 |
| EP | 1361176 | A1 | 11/2003 |
| EP | 1136393 | B1 | 4/2004 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 2343250 | A1 | 7/2011 |
| EP | 001908575-0001 | | 8/2011 |

(56) References Cited

FOREIGN PATENT DOCUMENTS

| | | | |
|---|---|---|---|
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| EP | 001381636-001 | | 8/2013 |
| EP | 001381792-0001 | | 8/2013 |
| EP | 2636611 | A1 | 9/2013 |
| EP | 2636613 | A1 | 9/2013 |
| EP | 3144251 | A1 | 3/2014 |
| EP | 001420590-0001 | | 9/2014 |
| EP | 2772454 | A2 | 9/2014 |
| EP | 2915763 | A1 | 9/2015 |
| EP | 2918518 | A2 | 9/2015 |
| EP | 002766782-0001 | | 11/2015 |
| EP | 002766782-0002 | | 11/2015 |
| EP | 002766881-0001 | | 11/2015 |
| EP | 2364932 | B1 | 4/2016 |
| EP | 3042864 | A1 | 7/2016 |
| EP | 003177500-0001 | | 9/2016 |
| EP | 003177500-0002 | | 9/2016 |
| EP | 003362235-0001 | | 10/2016 |
| EP | 003362052-0001 | | 11/2016 |
| EP | 003996339-0001 | | 5/2017 |
| EP | 003996339-0002 | | 5/2017 |
| EP | 3214019 | A1 | 9/2017 |
| FR | 2887152 | | 12/2006 |
| GB | 191004921 | | 6/1910 |
| GB | 2384418 | | 7/2003 |
| JP | 02-152670 | | 6/1990 |
| JP | H06-56011 | | 8/1994 |
| JP | 06-272888 | | 9/1994 |
| JP | 2004-106713 | | 4/2004 |
| JP | 2004-231237 | | 8/2004 |
| JP | D1300450 | | 5/2007 |
| JP | D1300451 | | 5/2007 |
| JP | D1322056 | | 2/2008 |
| JP | D1398668 | | 10/2010 |
| JP | D1550907 | | 4/2016 |
| JP | D1551184 | | 4/2016 |
| JP | 1585339 | | 8/2017 |
| KR | 3003841370000 | | 6/2005 |
| KR | 3004095430000 | | 3/2006 |
| KR | 3004095430001 | | 7/2006 |
| NL | 6908550 | | 12/1970 |
| TW | D129485 | | 7/2009 |
| TW | D133382 | | 2/2010 |
| TW | D133678 | | 3/2010 |
| TW | 145989 | | 3/2012 |
| TW | D147147 | | 5/2012 |
| TW | D154797 | | 7/2013 |
| TW | D158187 | | 1/2014 |
| TW | D161587 | | 7/2014 |
| TW | D162495 | | 8/2014 |
| TW | D168957 | | 7/2015 |
| TW | D170334 | | 9/2015 |
| TW | 201538406 | | 10/2015 |
| TW | D176312 | | 6/2016 |
| TW | D176313 | | 6/2016 |
| TW | D183552 | | 6/2017 |
| TW | D184449 | | 7/2017 |
| WO | WO 92/02430 | A1 | 2/1992 |
| WO | WO 96/33671 | | 10/1996 |
| WO | WO 2005/080232 | A1 | 9/2005 |
| WO | WO 2006/079263 | A1 | 8/2006 |
| WO | WO 2007/139570 | | 12/2007 |
| WO | WO 2009/114495 | A1 | 9/2009 |
| WO | WO 2015/134902 | A1 | 9/2015 |
| WO | WO 2015/138625 | A1 | 9/2015 |
| WO | WO 2016/054109 | A1 | 4/2016 |

OTHER PUBLICATIONS

U.S. Appl. No. 10/940,167, U.S. Pat. No. 7,694,838.
U.S. Appl. No. 11/448,336, U.S. Pat. No. 7,748,556.
U.S. Appl. No. 11/514,518, U.S. Pat. No. 7,781,995.
U.S. Appl. No. 11/475,349, U.S. Pat. No. 7,922,024.
U.S. Appl. No. 11/134,107, U.S. Pat. No. 7,922,024.
U.S. Appl. No. 12/024,945, U.S. Pat. No. 8,096,445.
U.S. Appl. No. 12/399,828, U.S. Pat. No. 8,418,869.
U.S. Appl. No. 13/801,140, U.S. Pat. No. 8,567,630.
U.S. Appl. No. 13/040,786, 2011/0220648.
U.S. Appl. No. 12/024,946, U.S. Pat. No. 8,569,980.
U.S. Appl. No. 13/040,709, 2011/0220646.
U.S. Appl. No. 12/045,641, 2008/0237234.
U.S. Appl. No. 13/040,770, 2011/0220647.
U.S. Appl. No. 29/263,255, U.S. Pat. No. D. 552,823.
U.S. Appl. No. 29,263,258, U.S. Pat. No. D. 552,825.
U.S. Appl. No. 29/267,029, U.S. Pat. No. D. 559,494.
U.S. Appl. No. 29/277,816, U.S. Pat. No. D. 578,266.
U.S. Appl. No. 29/303,204, U.S. Pat. No. D. 611,216.
U.S. Appl. No. 29/334,146, U.S. Pat. No. D. 615,722.
U.S. Appl. No. 29/357,571, U.S. Pat. No. D. 634,911.
U.S. Appl. No. 29/386,880, U.S. Pat. No. D. 657,108.
U.S. Appl. No. 29/411,482, U.S. Pat. No. D. 672,520.
U.S. Appl. No. 29/411,490, U.S. Pat. No. D. 675,802.
U.S. Appl. No. 29/411,491, U.S. Pat. No. D. 675,803.
U.S. Appl. No. 11/074,140, 2006/0196874.
U.S. Appl. No. 12/200,861, 2009/0084788.
U.S. Appl. No. 12/727,954, 2010/0237074.
U.S. Appl. No. 13/047,662, 2011/0220655.
U.S. Appl. No. 13/417,084, 2013/0233853.
U.S. Appl. No. 13/787,638, 2013/0233857.
U.S. Appl. No. 13/788,778, 2013/0248532.
U.S. Appl. No. 13/783,149.
U.S. Appl. No. 29/447,313.
U.S. Appl. No. 29/484,903.
U.S. Appl. No. 29/484,764.
U.S. Appl. No. 14/198,460.
U.S. Appl. No. 13/783,149, filed Mar. 1, 2013, Yang et al.
U.S. Appl. No. 29/447,313, filed Mar. 1, 2013, Yang et al.
U.S. Appl. No. 29/484,903, filed Mar. 13, 2014, Yang et al.
U.S. Appl. No. 29,484,764, filed Mar. 1, 2013, Yang et al.
U.S. Appl. No. 14/198,460, filed Mar. 5, 2014, Yang et al.
Trento Corner 23 Trash Can, Hailo product webpage, May 2008, http://www.hailo.de/html/default.asp?site=12_71_107&lang=en.
European Search Report for European Application No. 06010394, dated Aug. 24, 2006, in 1 page.
U.S. Appl. No. 14/637,270, filed Mar. 4, 2015, Yang et al.
U.S. Appl. No. 14/639,049, filed Mar. 4, 2015, Yang et al.
U.S. Appl. No. 14/639,862, filed Mar. 5, 2015, Yang et al.
U.S. Appl. No. 29/519,549, filed Mar. 5, 2015, Yang et al.
U.S. Appl. No. 29/519,551, filed Mar. 5, 2015, Yang et al.
U.S. Appl. No. 14/856,309, filed Sep. 26, 2015, Yang et al.
U.S. Appl. No. 15/265,455, filed Sep. 14, 2016, Yang et al.
U.S. Appl. No. 29/584,385, filed Nov. 14, 2016, Yang et al.
U.S. Appl. No. 13/047,662, U.S. Pat. No. 9,434,538.
U.S. Appl. No. 29/519,551, U.S. Pat. No. D. 759,934.
U.S. Appl. No. 29/548,018.
U.S. Appl. No. 29/557,032.
U.S. Appl. No. 29/557,088.
U.S. Appl. No. 29/563,650.
U.S. Appl. No. 29/548,018, filed Dec. 9, 2015, Yang et al.
U.S. Appl. No. 29/557,032, filed Mar. 4, 2016, Yang et al.
U.S. Appl. No. 29/557,088, filed Mar. 4, 2016, Yang et al.
U.S. Appl. No. 29/563,650, filed May 6, 2016, Yang et al.
U.S. Appl. No. 15/448,245, filed Mar. 2, 2017, Yang et al.
U.S. Appl. No. 15/476,285, filed Mar. 31, 2017, Yang et al.
U.S. Appl. No. 29/610,345, filed Jul. 11, 2017, Yang et al.
U.S. Appl. No. 29/583,627, filed Jun. 22, 2017, Yang et al.
U.S. Appl. No. 29/608,587, filed Jun. 22, 2017, Yang et al.
U.S. Appl. No. 15/809,218, filed Nov. 10, 2017, Yang et al.
U.S. Appl. No. 29/631,301, filed Dec. 28, 2017, Yang et al.
U.S. Appl. No. 29/633,369, filed Jan. 12, 2018, to be determined.
U.S. Appl. No. 29/633,372, filed Jan. 12, 2018, to be Determined.

(56) References Cited

OTHER PUBLICATIONS

Web page showing picture of Hero Bullet trash can, archived Nov. 17, 2004, downloaded from http://web.archive.org/web/20041117003115/http://www.simplehuman.com/images/hero_bullet.jpg.

* cited by examiner

RECEPTACLE WITH LOW FRICTION AND LOW NOISE MOTION DAMPER FOR LID

CROSS-REFERENCE TO RELATED APPLICATIONS

The present application claims priority to U.S. Provisional Application No. 61/535,908, entitled "RECEPTACLE WITH LOW FRICTION AND LOW NOISE MOTION DAMPER FOR LID," filed Sep. 16, 2011, which is herein incorporated by reference in its entirety.

FIELD

The present embodiments relate to receptacles having doors or lids, some of the embodiments relating to mechanisms configured to slow at least the closing movement of the lid.

BACKGROUND

Receptacles and other devices having lids or doors are used in a variety of different settings. For example, in both residential and commercial settings, trashcans and other devices often have lids or doors for preventing the escape of the contents from the receptacle. In the context of trashcans, some trashcans include lids or doors to prevent odors from escaping and to hide the trash within the receptacle from view. Additionally, the lid of a trashcan helps prevent contamination from escaping from the receptacle.

Recently, trashcans with rotary-type motion dampers for slowing the motion of the lids have become commercially available. More specifically, these rotary dampening mechanisms are connected to the lids of the trashcans so as to slow the closing movement of the lids. As such, the trashcan is more aesthetically pleasing because the lid closes slowly, thereby preventing a loud slamming noise when the lid is moved to a closing position.

These types of trashcans often are pedal-actuated, i.e., they include a foot pedal, which is connected to the lid for moving the lid toward the open position. The rotary mechanisms are connected to the internal linkage connecting the foot pedal to the lid so as to slow the closing movement of the lid.

SUMMARY

The embodiments of the present invention provide a receptacle having a lid with a high endurance, low noise and/or low friction damper. In particular, the damper may comprise lubricants, such as a graphite powder. The damper may also comprise a dampening material, such as foam infused with graphite powder, to disperse the lubricant over time. The damper may also employ surface features and other sound dampening features in its housings to reduce noise.

In one embodiment, a trash receptacle is configured to reduce audible noises during operation. The trash receptacle may comprise: a body having an open top portion; a lid, coupled to the body, configured to pivotably move between an open and a closed position relative to the body; an actuator, coupled to the lid, configured to move the lid via a linkage connected to the lid. The linkage moves in response to an applied force by a user. A dampening device is coupled to the linkage and is configured to reduce audible noises during movement of the lid. The dampening device comprises an interior surface having at least one surface feature. The dampening device may comprise a lubricant, various surface features, such as dimples, and may be infused with a material, such as Teflon or Duracon. Various exemplary embodiments will now be described below.

BRIEF DESCRIPTION OF THE DRAWINGS

The above mentioned and other features of the embodiments disclosed herein are described below with reference to the drawings of preferred embodiments. The illustrated embodiments are intended to illustrate, but not to limit the embodiments. The drawings contain the following figures.

DESCRIPTION OF THE EMBODIMENTS

The embodiments of a receptacle with a lid having at least one dampening device for dampening motion of the lid, an air filtration mechanism, and an anti-sliding device are all disclosed in the context of a trashcan. The embodiments disclosed herein are described in the context of a trashcan because they have particular utility in this context. However, the embodiments disclosed herein can be used in other contexts as well, including, for example, but without limitation, large commercial trashcans, doors, windows, security gates, and other larger doors or lids, as well as doors or lids for smaller devices, such as high precision scales, computer drives, etc.

Figure 1:
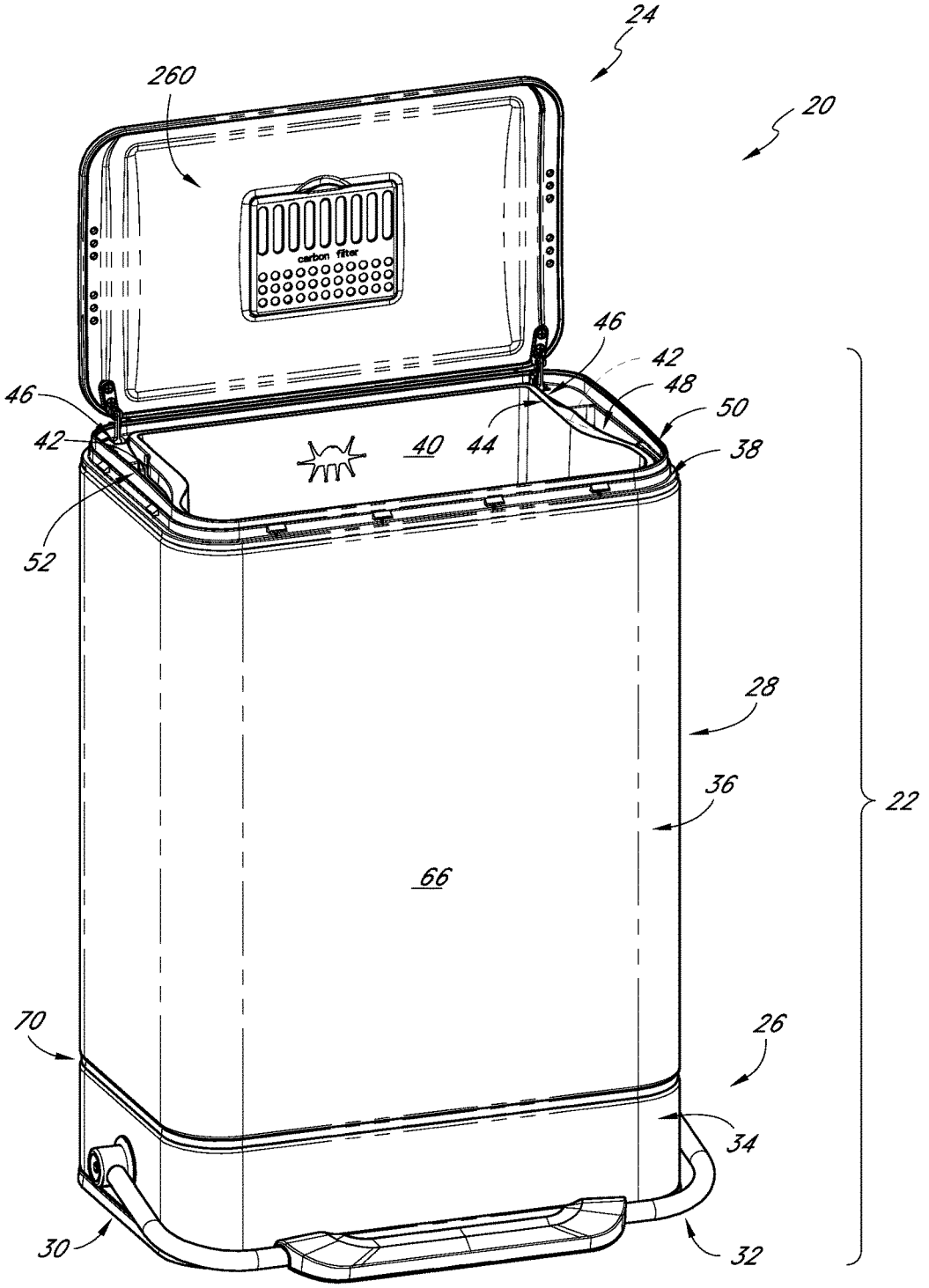
FIG. 1 is a top, front, and right side perspective view of a receptacle assembly in accordance with an embodiment, having a pedal-actuated lid and with the lid in its opened position.
Figure 2:
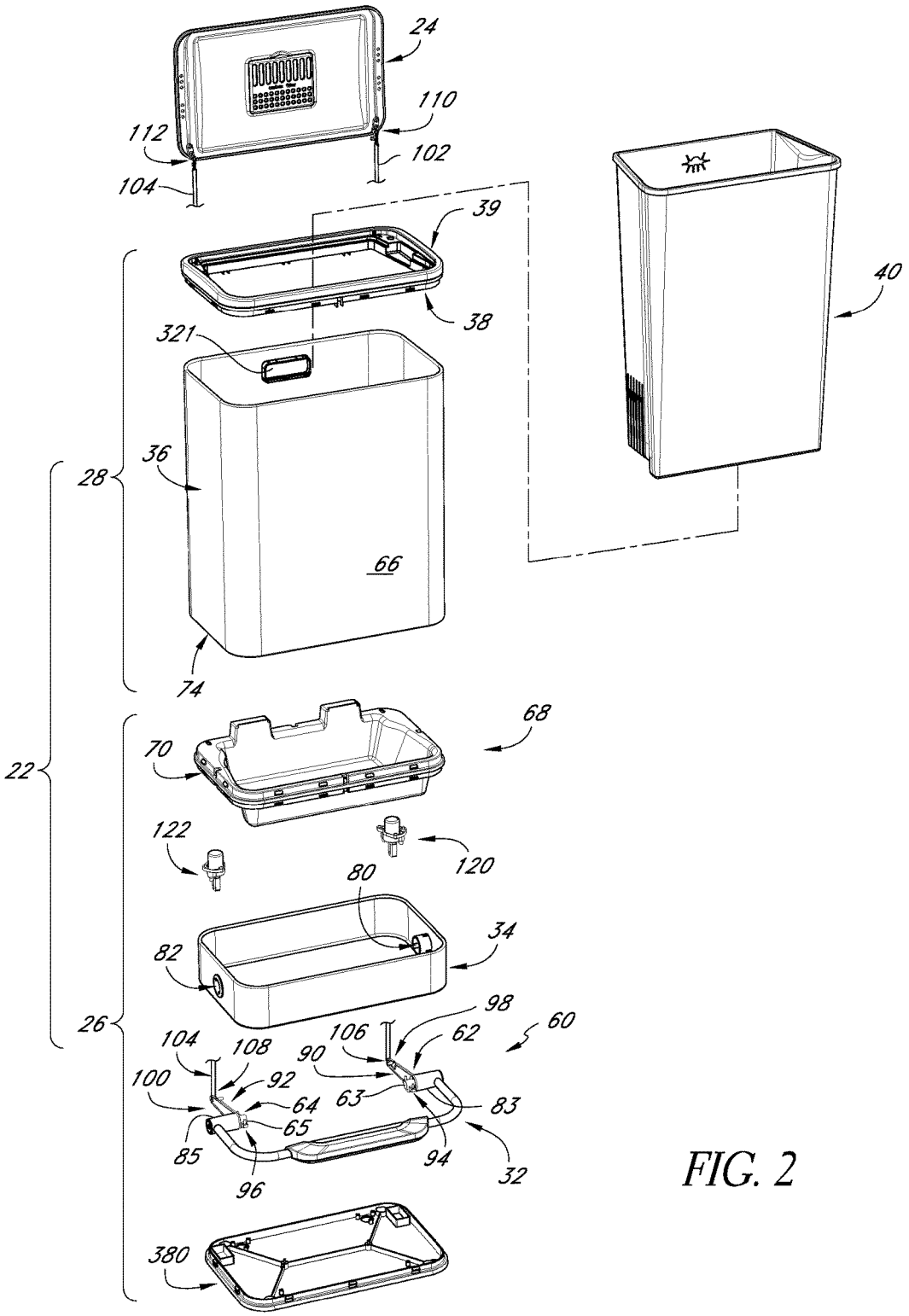
FIG. 2 is an exploded and perspective view of the trashcan illustrated in FIG. 1.

FIGS. 1 and 2 illustrate an embodiment of a receptacle assembly 20. The assembly can include a body portion 22 and a lid portion 24 configured to move between opened and closed positions relative to the body 22, the open position being illustrated in FIG. 1.

The body 22 can include a base portion 26 and an upper body portion 28. The base portion 26 and the upper body portion 28 can be made from a single monolithic piece or from separate pieces connected together.

In the illustrated embodiment, the base portion includes a lower end 30 configured to support the receptacle 20 in a stable resting position when the trashcan assembly 20 rests on a surface such as a floor, which may be smooth, or uneven. The base portion 26 can be configured to support the upper body portion 28 such that the upper portion 28 can extend upwardly from the base 26.

The base portion 26 can also provide a mounting arrangement for a pedal 32. The trashcan assembly 20 can further include a mechanism configured to move the lid 24 from the closed to open positions when the pedal 32 is depressed, i.e., from a resting position to an actuating position, discussed in greater detail below.

The base portion 26 can be made from a single monolithic piece and/or from separate components connected together. In some embodiments, the base portion 26 includes an outer shell 34, which defines an interior cavity. In some embodiments, the outer shell 34 can be formed from sheet metals, such as sheet stainless steel, or other metals, or other materials including plastics, etc. In some embodiments, when sheet metal is used, such as sheet stainless steel, the shell 36 can be made from any of 23-26 gauge stainless sheet steel. Of course, the thinner the gauge sheet steel, the lighter and less expensive the shell 36 will be.

The upper body portion 28 can also include an outer shell 36, which defines an interior cavity. In some embodiments, the outer shell 36 can be configured to correspond to the shape of the outer surface of the shell 34.

The upper body portion can also include an upper support member 38 supported by an upper end of the shell 36. The upper support member 38 can be made monolithically with the shell 36 or it can be made from separate components attached to the shell 36. Similar to the shell 34, the shell 36 can be made from any material, including sheet metals, such as stainless steel (e.g., 23-26 gauge stainless sheet steel as noted above), other metals, or other plastics.

The upper support member 38 can be configured to support a liner 40 within the interior cavity defined by the shells 34 and/or 36. In some embodiments, the upper support member 38 includes a shoulder 42 configured to support an outwardly extending lip 44 of the liner 40. As such, the liner 40 can hang within the shells 34 and/or 36 from the upper support member 38. However, in other configurations, the liner 40 can rest upon an interior surface of the upper body 28 or the base 26. In such a configuration, the upper support member 38, while it does not support the weight of the liner 40, can provide for alignment of the liner 40 within the body 22.

The upper support member 38 can also include one or more apertures 46 configured to allow a portion of a lid opening mechanism to extend there through, described in greater detail below.

The upper support member 38 can also include additional apertures 48 which can allow air to flow into a space between the liner 40 and an interior surface of the shell 36, also described in greater detail below.

The lid 24 can be moveably mounted to the body 22 with any known device, such as a hinge, which can allow pivoting motion of the lid 24, or other devices providing different movements. The connection between the lid 24 and the body 22 can be constructed so as to connect the lid 24 to the upper support member 38 or directly to the shell 36.

Although not illustrated in FIG. 1 or 2, the trashcan assembly 20 can also include an additional trim ring 39 (FIG. 2) extending around an outer surface of the upper support member 38. In some embodiments, the additional trim ring 39 can be made from the same material as the shell 36 so as to provide a consistent outer appearance.

As illustrated in FIG. 1, the upper support member 38 can include a peripheral wall 50 extending around the entire periphery of the support member 38. However, the wall 50 can include cutouts, notches, or gaps if desired.

Further, the upper support member 38 can include additional recesses configured to allow a user to insert their fingers below the flange 44 of the liner 40 so as to allow a user to conveniently lift the liner 40 out of the body 22. The wall 50 can also include an outer surface 52 that is configured to cooperate with a corresponding surface on the lid 24, described in greater detail below.

With continued reference to FIG. 2, as noted above, a lid opening mechanism 60 can be configured to move the lid 24 from the closed to opened positions when the pedal 32 is moved from the resting to the actuated position. In some embodiments, as used herein, the phrase "resting position" of the pedal 32 refers to a position where the pedal 32 is pivoted towards an upper position. The actuated position of the pedal 32 can refer to when the pedal 32 is pressed downwardly (as viewed in FIG. 1), for example, by the foot of a user.

To allow for this movement between an upwardly pivoted position corresponding to the resting position, and a downwardly pivoted position corresponding to the actuated position, the pedal 32 can be supported by at least one pivot connection 62. In the illustrated embodiment, there are two pivot connections 62, 64 disposed at laterally opposite positions relative to the front side 66 of the trashcan assembly 20. The pivot mechanisms 62, 64 can be formed in any known manner.

For example, the pivot mechanisms 62, 64 can be formed with bearings supported by and/or defined by the base portion 26. In some embodiments, bearings 80, 82 are supported by the shell 34. In other embodiments, the pivot mechanism 62, 64 can be supported by an additional support member 68 which also can form part of the base portion 62. In the illustrated embodiment, the bearings 80, 82 are in the form of sleeves configured to pivotally support shafts 83, 85 of the pedal 32.

The support portion 68 can be configured to nest within shell 34 and/or the shell 36. In the illustrated embodiment, the support 68 includes an outwardly extending flange 70, which rests on an upper edge of the shell 34. Additionally, the flange 70 can be positioned so as to contact and support a lower edge 74 of the shell 36. Thus, as shown in FIG. 1, the outermost surface of the flange 70 can be approximately flush with the outermost surfaces of the shells 34, 36. However, in other embodiments, the outermost surface of the flange 70 can extend outwardly relative to the outermost surfaces of the shells 34, 36 or can be recessed inwardly from the outermost surfaces of the shells 34, 36.

In some embodiments, the shell 34 can include apertures (not shown) sized to allow portions of the pivot mechanism 62, 64, respectively, to extend there through. In some embodiments, first and second pivot shafts 63, 65 extend inwardly from the ends of the pedal 32, and through the bearings 80, 82, respectively. Additionally, in other embodiments, the support member 68 can include apertures (not shown) configured to be aligned with the bearings 80, 82, respectively, and also provide support for the pivot mechanisms 62, 64, respectively or the shafts 63, 65, respectively.

The pivot mechanisms 62, 64 can define pivot axes about which the pedal 32 can pivot. In some embodiments, the pivot axes defined by the pivot mechanism 62, 64 fall along the same axis.

In some embodiments, the mechanism 60 can also include levers 90, 92. The levers 90, 92 can include first ends 94, 96 engaged with the pedal 32 so as to pivot therewith. For example, the first ends 94, 96, can be mounted to the shafts 63, 65, or the shafts 83, 85 so as to rotate therewith. However, other configurations can also be used.

The levers 90, 92 can also include distal ends 98, 100. The distal ends 98, 100 can be connected to one or more members 102, 104 configured to transfer the movement of the pedal 32 between its resting and actuated positions into the movement of the lid 24 between its opened and closed positions.

For example, in some embodiments, the members 102, 104 can be made from a single rod, connected at their lower ends. For example, a single u-shaped rod can form both the members 102, 104. However, in the illustrated embodiment, the members 102, 104 are formed from separate rods. The lower ends of the rods 106, 108 extend into apertures defined in the distal ends 98, 100 of the levers 90, 92. When assembled, the members 102, 104 extend upwardly through the interior of the shell 34, through the support 68, through the interior of the shell 36, through the apertures 46 in the upper support member 38, and to the lid 24.

The upper ends 110, 112 of the members 102, 104 can be configured to interface with the lid 24 so as to pivot the lid 24 relative to the body 22. For example, in some embodiments, the upper ends 110, 112 can press against a portion of the lid 24 radially offset from a pivot axis defined by the hinge connecting the lid 24 to the body 22. As such, the radially offset contact between the upper ends 110, 112 and the lid 24 can cause the lid 24 to pivot about the hinge.

In other embodiments, the lid can include mounting tabs engaging the upper ends 110, 112 in a hinge-type arrangement. As such, the upper ends 110, 112 pivot within the hinge defined by the tabs, and thus move the lid 24 between its opened and closed positions, as the members 102, 104 are moved upward and downwardly in accordance with the movement of the pedal 32. This type of mechanism 60 is well known in the art, and thus, can be modified according to the shape and size of the overall trashcan 20.

In an exemplary configuration, the resting position of the pedal 32 is a position in which the pedal 32 is pivoted upwardly such that the distal ends 98, 100 of the levers 90, 92 are pivoted downwardly. In this position, the members 102, 104 are also pulled into a downward position, which would also correspond to the lid 24 being in a closed position. When a user steps on the pedal 32, thereby pivoting the pedal 32 downwardly, the levers 90, 92, pivoting about the axes defined by the pivot mechanisms 62, 64 pivot upwardly, thereby lifting the rod members 102, 104. As the rod members 102, 104 rise, the upper ends 110, 112 of the members 102, 104 press against the lid 24 or associated tabs, thereby moving the lid 24 from the closed position toward the open position.

With continued reference to FIG. 2, the trashcan assembly 20 can include one or more dampening devices 120, 122. The dampening devices 120, 122 can be any type of dampening device including, for example, but without limitation, rotary dampening devices, friction dampening devices, or fluid damping devices operating with liquid or gaseous working fluids. Other types of dampening mechanisms can also be used.

In some embodiments, the trashcan assembly 20 can include at least two dampening mechanisms, 120, 122 arranged so as to provide dampening against the movement of opposite ends of the pedal 32. The description of the damper 120 sets forth below applies to both the dampers 120, 122, although only the damper 120 and the components thereof are specifically identified below. Thus, the damper 122 can have a construction that is similar or identical to the damper 120.

Figure 3:
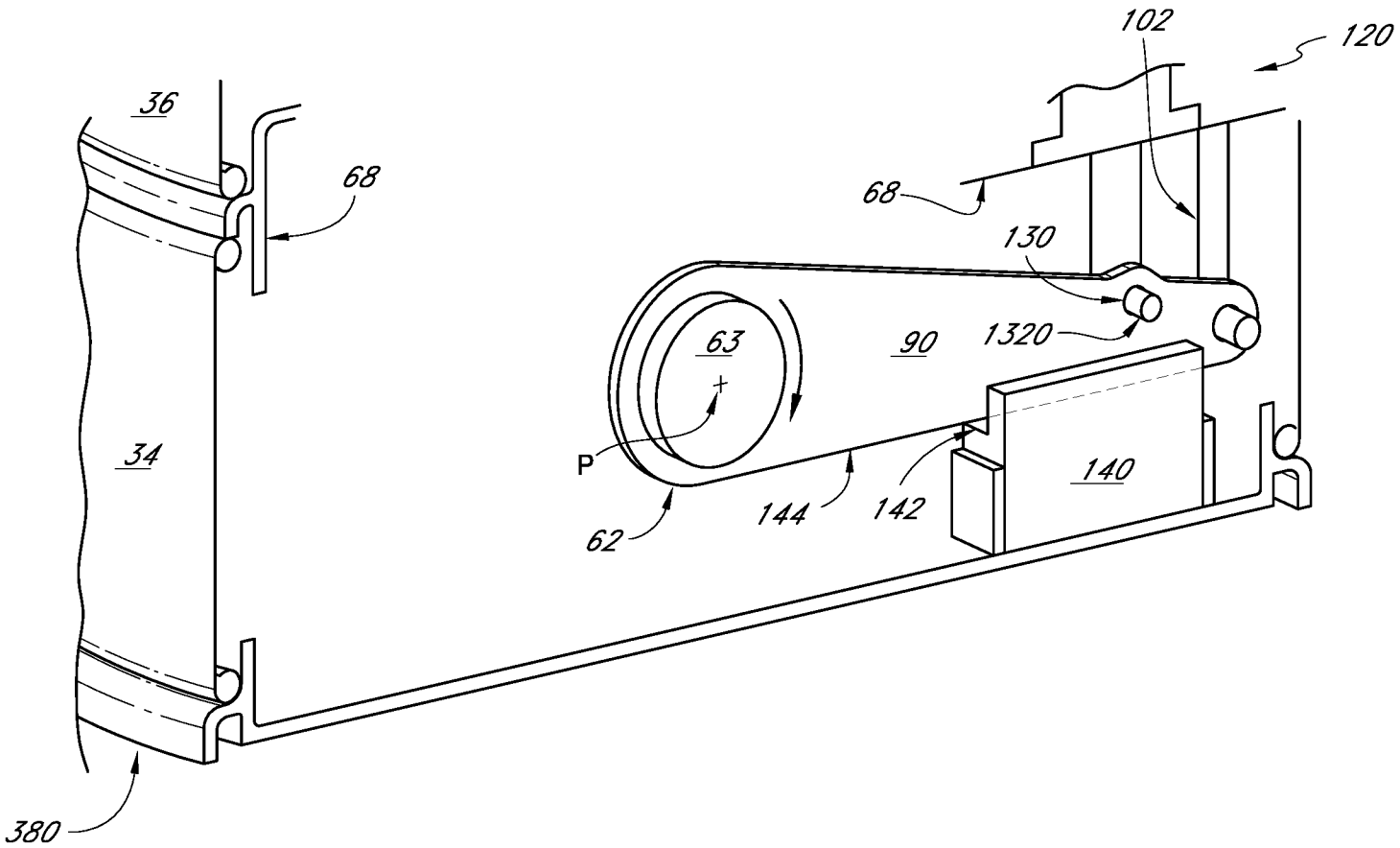
FIG. 3 is an enlarged, perspective, and partial sectional view of a mechanism disposed in the interior of the receptacle of FIG. 1 and connecting the pedal with a mechanism for opening the lid and with a dampening mechanism.

With reference to FIG. 3, the damper mechanism 120 can be attached to a lever 90 in any known manner. In some embodiments, the damper 120 can be connected to the member 102 to thereby connect the damper mechanism 120 to the lever 90. Alternatively, the damper mechanism 120 can be directly connected to the lever 90.

In the illustrated embodiment, the damper mechanism 120 is connected to the lever 90 at an aperture 130. A connecting member 1320 of the damper 120, such as a pin, extends through the aperture 130, to thereby connect the lever 90 to the damper 120. In some embodiments, the damper 120 can be configured to dampen the downward movement of the lever.

As used herein, the "downward movement" of the lever 90 corresponds to the clockwise pivoting motion of the lever 90 about the pivot axis P defined by the pivot mechanism 62, as viewed in FIG. 3. This downward movement of the lever 90, i.e., clockwise pivot as viewed in FIG. 3 about the axis P corresponds to the movement of the lid 24 from the open position toward the closed position. As such, after a user releases the pedal 32 (FIG. 1 and FIG. 2) the damper mechanism 20 dampens the downward pivotal movement of the lever 90 and the lid 24.

The lid 24 and the pedal 32 can be biased toward the closed and resting positions, respectively, by way of any known device or configuration. For example, the weight of the lid 24 can be sufficient to move the lid 24 toward the closed position when nothing (other than gravity) is acting against the pedal 32. Optionally, springs can be added to the trashcan assembly 20, in any known configuration, to bias the lid 24 toward the closed position, and/or the pedal 32 to the resting position.

FIG. 3 also illustrates an optional stopper 140. The stopper 140 can be configured to define a limit of movement for the lever 90. For example, the stopper 140 can be configured to prevent the further downward pivoting of the lever 90 beyond a predetermined point.

Optionally, the stopper 140 can include an upper surface 142 positioned so as to press against a lower surface 144 of the lever 90. The position of the surface 142 can be arranged to stop the downward pivoting motion of the lever 90 as the lid 24 reaches its closed position.

In some embodiments, the stopper 140 can be positioned such that its uppermost surface is in a position in which the lower surface 144 of the lever 90 contacts the surface 142 just prior to the lid 24 reaching its fully closed position. As such, the stopper 140 can slow the closing movement of the lid 24 further and prevent the lid 24 from impacting the body 22 as it reaches its closed position. Further, in such a configuration, the stopper 140 can be made from soft and/or flexible materials such as foam rubber. Thus, the position of the stopper 140, its upper surface 142, and the material used to form the stopper 140 can be chosen to achieve the desired performance. In some embodiments, the stopper 140 is supported by the lower member 380 of the base 26. Additionally, in some embodiments, the damper 120 can be mounted to a portion of the support 68. FIG. 3 schematically illustrates the damper 120 being mounted to the support 68.

The positioning of the stopper 140 in the interior of the body 22 can provide further advantages. For example, when any of the moving components of the trash can 20 contact other components, there is the potential that such a contact can generate a noise. Thus, the lid 24 can generate noise when it contacts the upper support 38 or the liner 40 as the lid 24 reaches the closed position. Because the point of contact is also close to or at the boundary between the interior and exterior of the trash can 20, and because the lid is often the part of the trash can 20 that is the closest to the ears of a user, it is more likely that a noise generated by the lid 24 making contact with another component will be perceptible by the user.

Thus, by providing the stopper 140, or any other device configured to contact a moving component, in the interior of the trash can 20, any noise generated by contact between such internal components is less likely to be perceptible by the user. Additionally, by placing the stopper 140 near the bottom of the trash can 20, any noise generated by contacts is also less likely to be perceptible to a user. In operation, the stopper 140 can absorb some of the energy of the movement of the lid 24 toward its closed position, prior to the lid 24 reaching its closed position. This can also aid in reducing or eliminating noise that may be generated by the lid 24 reaching its closed position.

Figure 4:
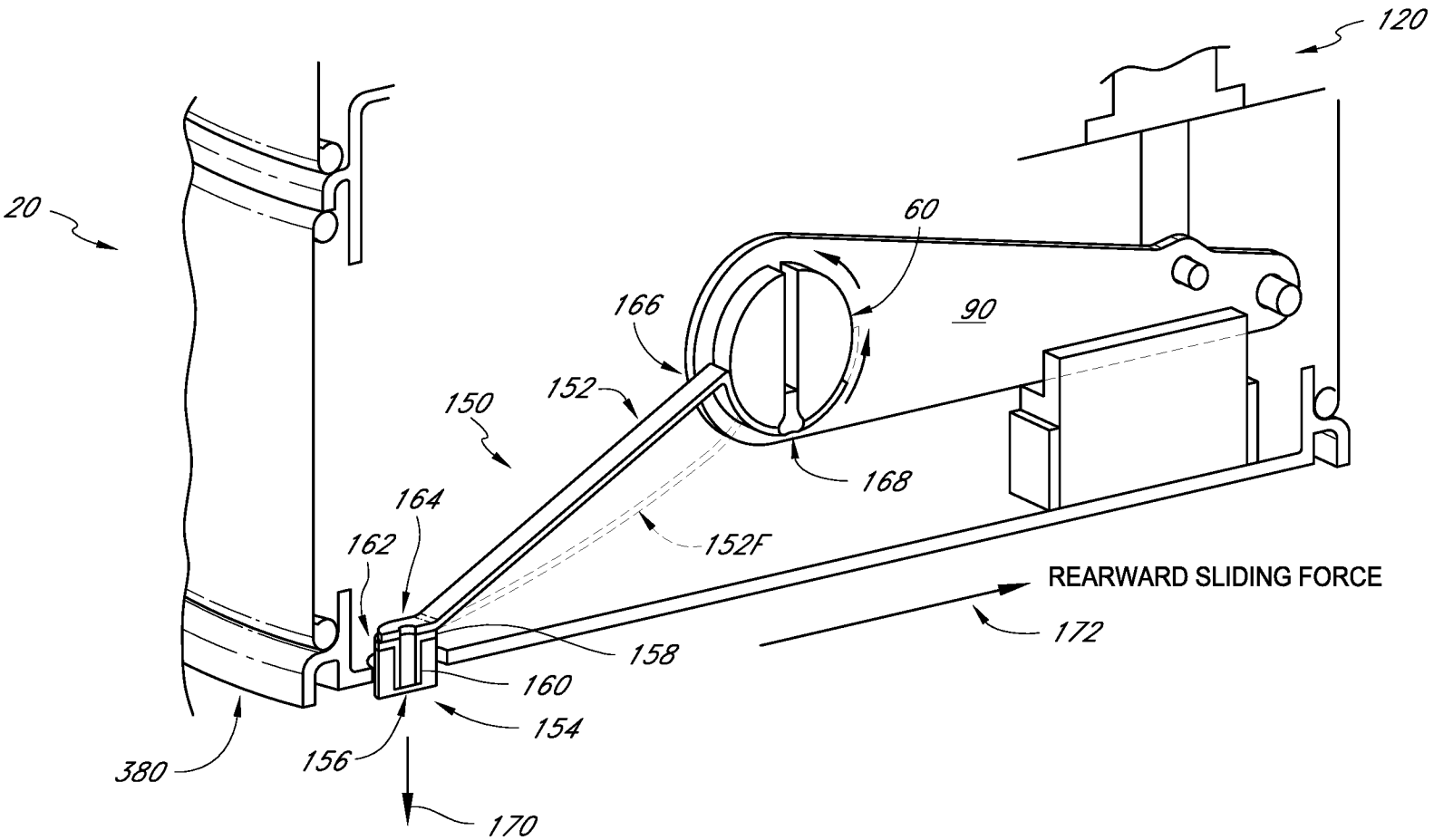
FIG. 4 is an enlarged, perspective, and partial sectional view of a modification of the embodiment illustrated in FIG. 3, including a mechanism designed to resist sliding of the receptacle during actuation of the pedal.

With reference to FIG. 4, the trashcan assembly 20 can also include an anti-sliding mechanism 150. The anti-sliding mechanism 150 can be configured to prevent or reduce a sliding motion caused by the forces generated when an operator depresses the pedal 32. In some embodiments, the anti-sliding mechanism 150 can be configured to increase an effective coefficient of friction between the trashcan assembly 20 and a surface upon which the trashcan 20 rests as the pedal 32 is moved from its resting position toward its actuating position.

For example, but without limitation, the anti-sliding mechanism 150 can be configured to convert the movement of the pedal 32, from its resting position toward its actuated position into a force pressing a friction member against the surface upon which the trashcan assembly 20 is resting. Such a surface can be, for example, but without limitation, vinyl flooring, wood flooring, carpeting, etc.

In some embodiments, as illustrated in FIG. 4, the anti-sliding mechanism includes an arm 152 connected to a friction device 154. The friction device 154 can be formed with any type of device that can generate friction at a contact patch between itself and the types of surfaces commonly found in homes, noted above, such as vinyl flooring, wood flooring, carpeting, etc.

In some embodiments, the friction device 154 can include a contact member 156 made of any rubber, or other material. Further, the contact member 156 can be made of a material or can include a surface texture that generates coefficients of friction with the typical flooring materials that are greater than the coefficients of friction between the other projections on the bottom of the base 26 and those types of flooring materials.

For example, as noted above, the base 380 can include projections in the form wheels, casters, gliders, and/or other extensions that together support trash can 20 in a stable and upright position on a surface, such as those flooring material surfaces noted above. Thus, the friction device 154 can include at least a portion (e.g., the contact member 156) made from a material or including a surface texture that provides a greater coefficient of friction with the typical flooring materials than the coefficient of friction between the other projections. In embodiments where there are a plurality of different projections on the bottom of the trash can assembly 20, an effective coefficient of friction of the combination of those projections and each flooring material can be determined experimentally, based on the resistance of the trashcan 20 against sliding along each of the different surfaces.

In some embodiments, the contact member can include an engagement member 158 configured to provide engagement between the contact member 156 and the arm 152. In some embodiments, the engagement member 158 can include a shaft portion 160 extending into a central portion of the contact member 156 and an upper flange portion 162. The upper flange portion 162 can be connected to a distal end 164 of the arm 152. However, other configurations can also be used.

A proximal end 166 of the arm 152 can be connected to the pedal 32, the lever 90, or the pivot mechanism 60. In the illustrated sectional view of FIG. 4, the proximal end 166 of the arm 152 is attached to a portion of the pivot mechanism 60. In the illustrated embodiment, this portion of the pivot mechanism 60 has a round outer surface.

The proximal end 166 of the arm 152 extends around a portion of the periphery of the pivot mechanism 60. Additionally, a screw 168 secures the proximal end 166 of the arm 152 to the pivot mechanism 60. The illustrated portion of the pivot mechanism 60 pivots with the lever 90 and the pedal 32 during operation.

Thus, with continued reference to FIG. 4, during operation, when the pedal 32 is moved downwardly from its resting position to its actuated position, the pivot mechanism 60 pivots in a counterclockwise direction (as viewed in FIG. 4). As such, the proximal portion 166 of the arm 152 is also pivoted in the same direction. However, because the distal end 164 of the arm 152 is attached to the contact member 156, which is positioned to contact the surface upon which the trashcan assembly 20 sits, the arm 152 is bent into the configuration illustrated in phantom line and identified by the reference numeral 152F. As such, this flexation of the arm 152 generates a downward force identified by the arrow 170. This downward force transfers some or all of the normal force created by the weight of the trashcan assembly 20 and the downward pressing of the pedal 32 by the user, to the contact member 156, thereby raising the coefficient friction existing between the trashcan assembly 20 and the surface which the contact member 156 contacts, i.e., the surface upon which the trashcan assembly 20 rests. This is because, as noted above, the contact member can be configured, by way of the material used to form the outer surface of the contact member 156 or the surface texture of the contact member 156 to have a greater coefficient of friction (with a flooring surface) than that of the other projections on the bottom of the base 380.

With reference again to FIG. 1, when a user depresses the pedal 32 with their foot, occasionally, a user can also push against the pedal 32 generating a rearward sliding force identified by the arrow 172 in FIG. 4. Thus, by providing the anti-sliding mechanism 150, an additional friction or "anti-sliding" force can be generated between the contact member 156 and the surface upon which the trashcan assembly 20 rests, to thereby prevent or reduce the rearward sliding motion of the trashcan assembly 20. In some embodiments, the arm 152 is made from a spring steel. However, other materials can be used. Additionally, the shape and configuration of the anti-sliding mechanism 150 can be designed, by one of ordinary skill in the art, to provide the desired amount of friction.

With reference to FIGS. 5-8, the damper mechanism 120 can be a fluid type damper operating with air as the working fluid. In the illustrated embodiment, the damper mechanism 120 can include a housing 200. The housing 200 can be mounted anywhere the trashcan assembly 20. In some embodiments, as illustrated schematically in FIG. 3, the housing 200 of the damper mechanism 120 can be mounted to the support member 68 of the base 26.

The housing 200 can define a cylinder in which a damper piston 202 can reciprocate. The dampening function of the dampening mechanism 120 is achieved by way of the resistance of the flow of a fluid, such as air, into and out of the housing 200. This can generate sufficient damping forces for slowing the closing of the lid 24. Such forces can be large.

The piston 202 can include a piston head 203 and a piston rod extending from the piston head 203 and outwardly from a lower end of the housing 200. The piston rod 205 can include an aperture 207 configured to allow the piston rod 205 to be pivotally connected to another member, such as the rod 132 or another member.

Figure 5:
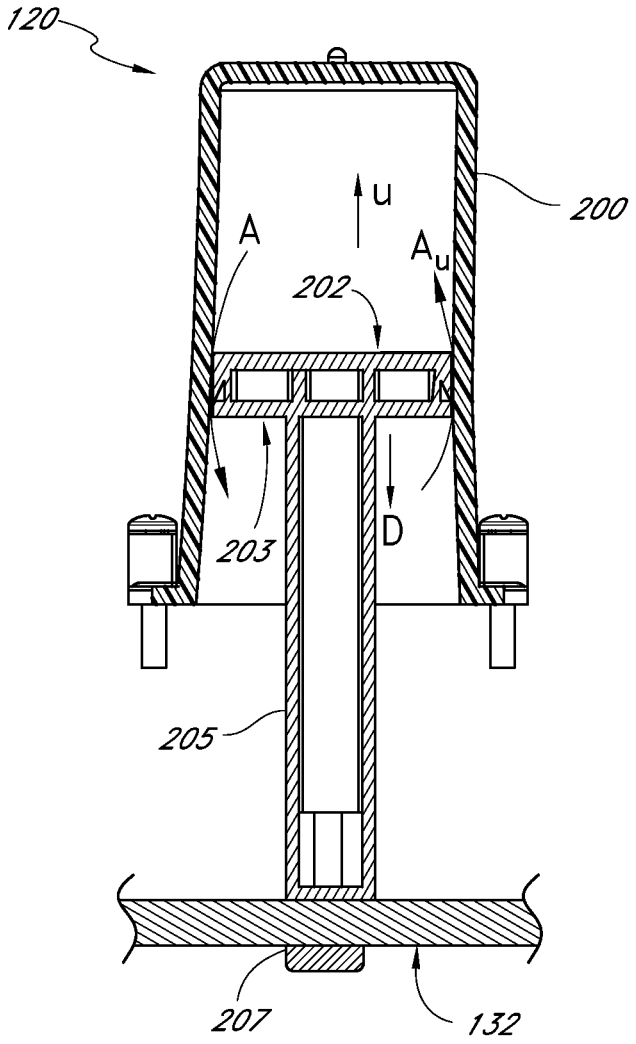
FIG. 5 is an enlarged sectional view of a damper mechanism that can be used with the receptacle illustrated in FIG. 1.

With continued reference to FIG. 5, when the pedal 32 (FIG. 1) is pressed toward the open position, the piston 202 inside the damper housing 200 is moved toward its uppermost position. With reference to FIG. 2, in the open position, the members 102, 104 hold the lid 24 toward in the open position, and the rear ends 98, 100 of the levers 90, 92 are also raised with respect to the foot pedal 32. When the rear of the levers 90, 92 are raised, the piston 202 is pushed upwardly inside the damper housing 200 by way of its connection to the lever 90, to the uppermost position illustrated in FIG. 8.

When the force on the pedal 32 is released, the combined forces from the weight of the lid 24 (if applicable), the weight of other components connected to the lid 24 and/or other biasing devices configured to bias the lid 24 toward the closed position, push the members 102, 104 downwardly. As the members 102, 104 move downwardly, they push the rear ends of the levers 90, 92 downwardly, thereby pulling the piston 202 downwardly within the housing 200 (FIG. 5). However, the relative pressure between the atmosphere acting on the bottom of the piston 202 and the air trapped between the top of the piston 202 and the top of the housing 200 opposes the immediate downward motion of the piston 202 as the piston begins to move downwardly, and thus opposes the downward motion of the rear ends of the levers 90, 92, and thus opposes the downward motion of the lid 24 toward its closed position.

In some embodiments, the piston 202 can be configured to provide less resistance to the upward movement of the piston 202 within the housing 200 but provide greater resistance against the downward movement of the piston 202 within the housing 200. This can be accomplished in any known manner.

Figure 6:
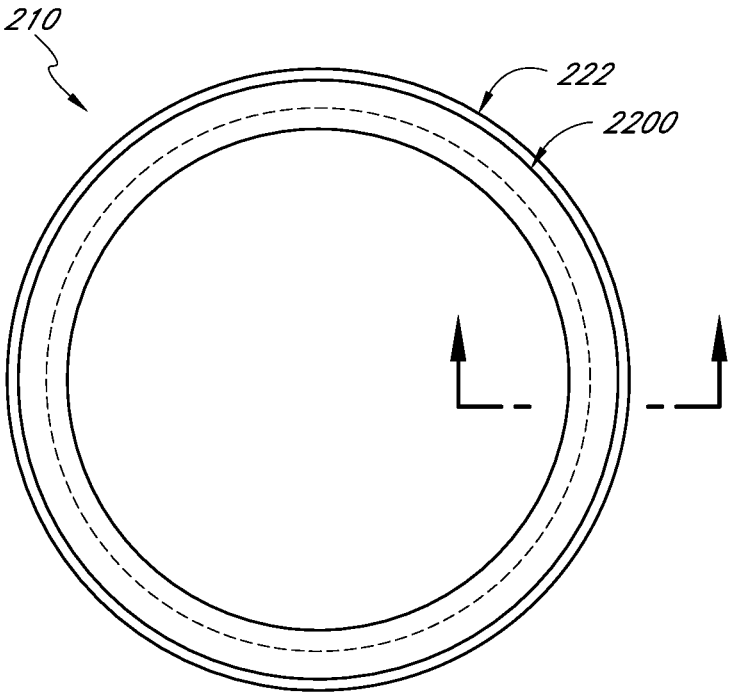
FIG. 6 is a top plan view of a lip seal that can be used with a damper illustrated in FIG. 5.
Figure 7:
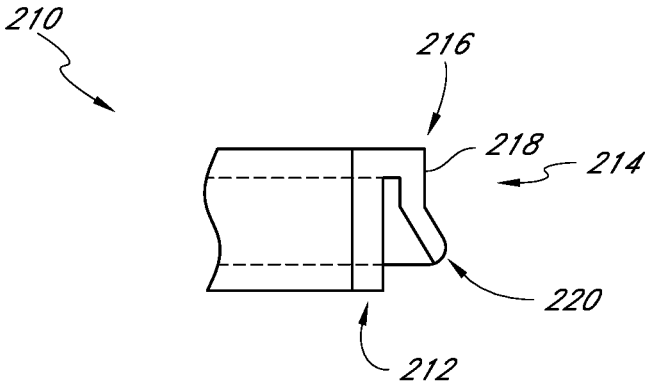
FIG. 7 is a sectional view of the lip seal of FIG. 6 taken along line 7-7 of FIG. 6 taken along line 7-7 of FIG. 6.

In the illustrated embodiment, and with additional reference to FIGS. 6 and 7, the piston 202 can be provided with a lip seal 210. In some embodiments, the lip seal 210 can be configured to operate similarly to a check valve. Thus, the lip seal 210 can have any configuration that can provide a similar function.

In the illustrated embodiment, the lip seal 210 is generally annular in shape, having an inner wall 212 and an outer wall 214 connected by a top wall 216. The outer wall 214 can include an upper portion 218 that extends generally parallel to the inner wall 212 and a projecting portion 220 that is biased to extend radially outwardly relative to the upper portion 218. As such, the outer diameter 2200 defined by the upper portion 218 is slightly smaller than the diameter 222 defined by the projecting portion 220. Additionally, the ramped configuration of the projecting portion 220 (when in a relaxed state) relative to the upper portion 218 helps to achieve the check valve type functionality of the lip seal 210.

For example, with reference to FIG. 5, as the piston 202 moves upwardly within the housing 200 in the direction of arrow U, air A flows downwardly along the inner walls of the housing 200, past the projecting portion 220 of the lip seal 210. Due to the ramped shape of the projecting portion 220, the pressure generated within the upper portion of the housing 200 above the piston 202 helps deflect the projecting portion 220 radially inwardly, thereby allowing the air A to pass thereby without generating a larger resistance.

However, when the piston 202 moves downwardly within the housing 200, the air pressure in the space above the piston 202 drops relative to the pressure of the atmosphere, thereby causing the projecting portion 220 to further expand against the inner walls of the housing 200. This generates additional resistance to the flow of air Au into the space above the piston 202. As such, the lip seal 210 generates more resistance to the downward movement of the piston 202 than against the upward movement of the piston 202.

In some embodiments, the lip seal 210 can be lubricated with graphite powder. Such lubrication with graphite powder and the construction of dampers, which can be applied to the present dampers 120, 122, are disclosed in U.S. Pat. Nos. 6,513,811 and 6,726,219, the entire contents of both of which, including the specific portions including the descriptions of damper design and lubrication with graphite powder, are hereby incorporated by reference. Additionally, the size of the dampening mechanism 120 can be chosen by the designer to provide the desired functionality and performance.

Figure 8:
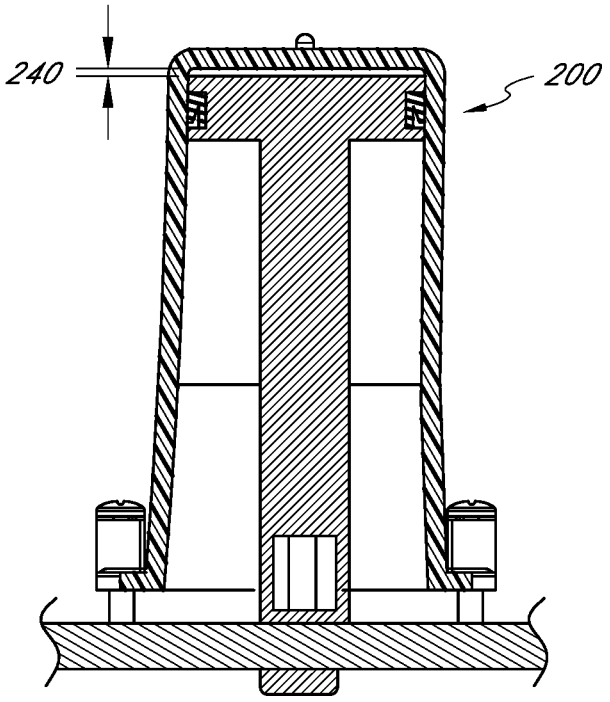
FIG. 8 is a sectional view of the damper mechanism of FIG. 5 in a position corresponding to when the lid is opened to its maximum opened position.

For example, with reference to FIG. 8, the height of the housing 200, which determines the length of the maximum vertical movement of the piston 202 within the housing 200, can be chosen to accommodate the maximum vertical displacement of the point at which the dampening mechanism 120 is attached to the lever 90 (FIG. 3). Additionally, the diameter of the housing 200 and the type of lip seal 210 used affects the resistance generating during the downward movement of the piston 202. Thus, these dimensions can be chosen to provide the desired dampening characteristics.

Further advantages can also be achieved where the size of the housing 200 and the position at which the housing 200 is mounted within the assembly 20 can be adjusted to provide desired characteristics of the motion of the lid 24 during its closing movement. For example, it has been found that if the housing 200 is mounted in a position where the piston 202 is spaced excessively far from the top of the housing 200 when the piston 202 is at its maximum vertical position, the lid 24 can initially move too quickly from its fully opened position toward its closed position. Such an initial quick movement can cause the lid 24 to bounce during its downward movement.

However, if the mounting position of the housing 200 is adjusted so that the piston 202 is closely spaced relative to the top of the housing 200 when the piston 202 is at its maximum upper position (FIG. 8), the damper provides additional dampening, at least initially, thereby providing a slower, more aesthetically pleasing motion.

For example, by adjusting the position of the housing 200 such that a spacing between the piston 202 and the top of the housing 200 when the piston 202 is at its maximum position, when the foot pedal 32 is released, the lid 24 can begin to move very slowly initially, and slowly accelerate to an acceptably slow closing speed, such that the lid 24 does not make an excessive loud noise when it finally comes to rest against the support 38. In some embodiments, the spacing 240 can be equal to or less than about 10% of the total movement of the piston 202. The initial movement of the piston 202 is further slowed at the spacing 240 is about 5% or less of the total movement of the piston 202. Finally, mounting the housing 200 such that the spacing is about 4% or less of the total movement of the piston 202 provides further slowing, and thus achieves a more aesthetically pleasing movement.

A designer can choose the appropriate housing, piston, and lip seal combination to achieve the desired closing speed. Thus, in some embodiments, at least one of the lid 24, housing 200, piston 202, lip seal 210, pedal 32, and position of the pivot mechanism 62, 64 can be configured to achieve the desired closing speed. In some embodiments, for example, but without limitation, the above parameters can be chosen to achieve a closing speed of the lid of about 4-5 seconds from the moment a user removes their foot from the pedal 32.

With reference again to FIG. 2, the dampening mechanism 122 can be constructed and attached to the lever 92 in the same manner that the dampening mechanism 120 is attached to the lever 90. Additionally, the dampening mechanism 122 can be configured to provide approximately the same dampening performance as the dampening mechanism 120.

Thus, when the pedal 32 is actuated by a user, for example, when a user steps on the pedal 32 to move the pedal 32 from its resting position, pivoting downwardly toward its actuated position, the pistons within the dampening mechanisms 120, 122 are moved to their respective uppermost positions. During this motion, due to the arrangement of the lip seals 210 in each of these dampening mechanisms 120, 122, the dampening mechanisms 120, 122 provide little resistance to this opening motion. However, when the pedal is released by the user, the dampening mechanisms 120, 122 provide essentially the same dampening forces against the movement of the levers 90, 92. Thus, the dampening forces are applied more equally and more balanced to the pedal 32. As such, the movement of the pedal 32 from its actuated position back towards it resting position is more uniformed and is less likely to allow the pedal 32 to remain in a position that is twisted relative to the body 22.

Figure 9:
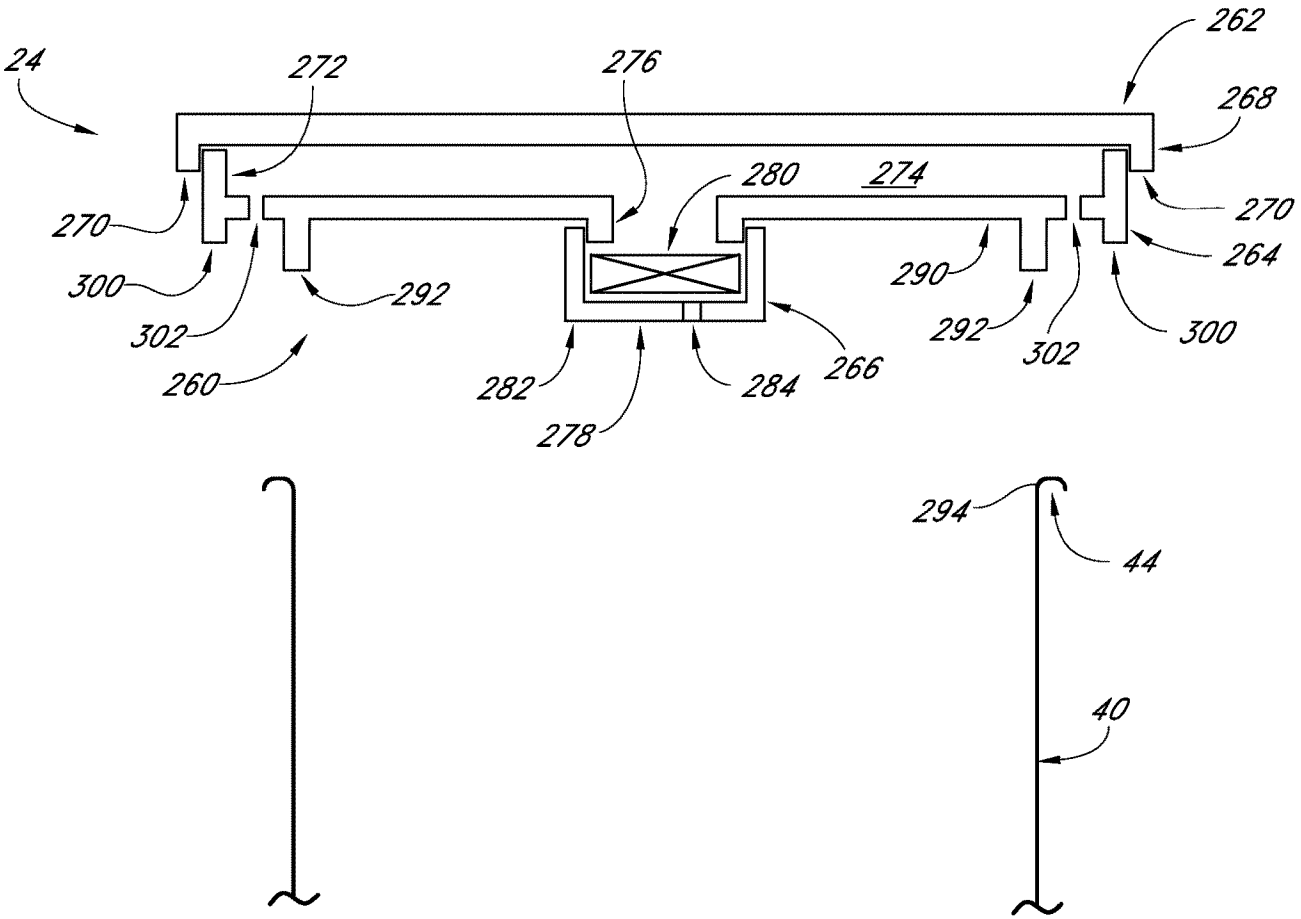
FIG. 9 is a schematic illustration of an air filtration device that can be used with the trashcan of FIG. 1, which includes an air guide assembly mounted to an interior side of the lid of the trashcan.

With reference to FIG. 1, the lid 24 can also include a filtration mechanism 260. FIG. 9 is a schematic representation of the air filtration device 260, which is incorporated into the lid 24 in the illustrated embodiment.

As schematically shown in FIG. 9, the lid can include an outer lid member 262, an air guide 264 and a filter holder 266. The outer lid member 262 can be formed in any known manner. In some embodiments, the outer lid member 262 is formed from a piece of sheet metal, such as stainless steel. However, other materials can also be used. In the illustrated embodiment, the outer lid member 262 is solid and does not include any air holes. However, other configurations can also be used in which the outer lid member 262 includes air holes, and/or other features.

As shown in FIG. 9, an outer periphery 268 of the outer lid member 262 includes a shoulder 270. In the illustrated embodiment, the shoulder 270 extends downwardly from the outer periphery 268 of the outer lid member 262.

The air guide 264 can include an upper outer peripheral shoulder 272. In the illustrated embodiment, the upper outer peripheral shoulder 272 extends around the entire periphery of the air guide 264. Additionally, the outer surface of the upper outer peripheral shoulder 272 is configured to sit within the shoulder 270 of the outer lid member 262.

In some embodiments, the fit between the upper outer shoulder 272 and the shoulder 270 can form a generally air resistant seal. However, it is not necessary for the shoulder 272 and the shoulder 270 to form an air resistant seal. The contact and or close spacing between the shoulders 272, 270 can be sufficiently continuous to significantly resist the flow of air there between. Additionally, in some embodiments, an adhesive or other sealant can be used to form a seal between the shoulders 270, 272. With the air guide 264 fit with the outer lid member 262, a space 274 between the outer lid member 262 and the air guide 264.

The air guide 264 can also include an inner aperture 276. Additionally, the air guide 264 can include a filtration device 278 fit over the aperture 276. In some embodiments, the filtration device 278 can include a filter member 280 and a filter housing 282.

The filter member 280 can be any type of known filter device, such as those including activated charcoal. Preferably, the filter device 280 is configured to remove odors from air, such as those odors normally generated or discharged by common household trash.

The filter housing 282 can include an internal cavity designed to contain the filter device 280 and to seal against the aperture 276. Additionally, the cover 282 can include one or more apertures 284 configured to allow air to move from the exterior into the interior of the cover 282. Further, the cover 282 can be configured to form an additional seal around the periphery of the filter member 280 such that air entering the aperture 284 through the cover 282 will pass through the filter 280 before passing to the space 274. The movement of the air in such a manner is described in greater detail below.

A lower surface 290 of the air guide 264 can include an additional inner peripheral shoulder 292. The inner peripheral shoulder 292 can be configured to define an outer peripheral shape that is complementary to an inner peripheral shape of an upper end of an inner peripheral surface 294 of the liner 40. As such, when the lid 24 moves toward its closed position, the shoulder 292 can move into close proximity and/or make contact with the inner peripheral surface 294 of the liner 40. This can help in guiding the air from the interior of the trashcan assembly 20, into the filtration device 266, into the space 27 4, described in greater detail below. This close proximity or contact between the shoulder 292 and the inner peripheral surface 294 can also form an air resistant seal when the lid 24 is in its fully closed position, which can further aid in guiding the air from the interior of the trashcan assembly 20, into the filtration device 266, into the space 274.

The air guide 264 can also include an outer downwardly extending shoulder 300. The outer downwardly extending shoulder 300 can extend around the entire periphery of the air guide 264. Additionally, the outer downwardly extending peripheral shoulder 300 can be sized and shape to move into close proximity and/or make contact with the upwardly extending wall 50 (FIG. 1) of the upper support 38, and in some embodiments, form an air resistant seal. The air guide 264 can also include apertures 302 disposed outwardly from the shoulder 292.

During operation, for example, as the lid 24 moves from its open position toward its closed position, a slight compression of the air within the liner 40 can be generated. For example, when the lid 24 is in its open position, the air within the liner 40, existing within and above any trash that may be contained in the liner 40, is at atmospheric pressure. However, as the lid 24 pivots downwardly toward its closed position, and as the various shoulders at the periphery of the lid 24 come into the vicinity of corresponding shoulders and surfaces on the body 22, a positive air pressure can be created within the liner 40. On known trashcan designs with flat lids, this would typically cause a puff of air to be discharged from the interior of the trashcan assembly 20. If the air within such a trashcan contains strong odors, such odors would be pushed out into the room in which such a trashcan is positioned and likely toward a user of such a trashcan.

Figure 10:
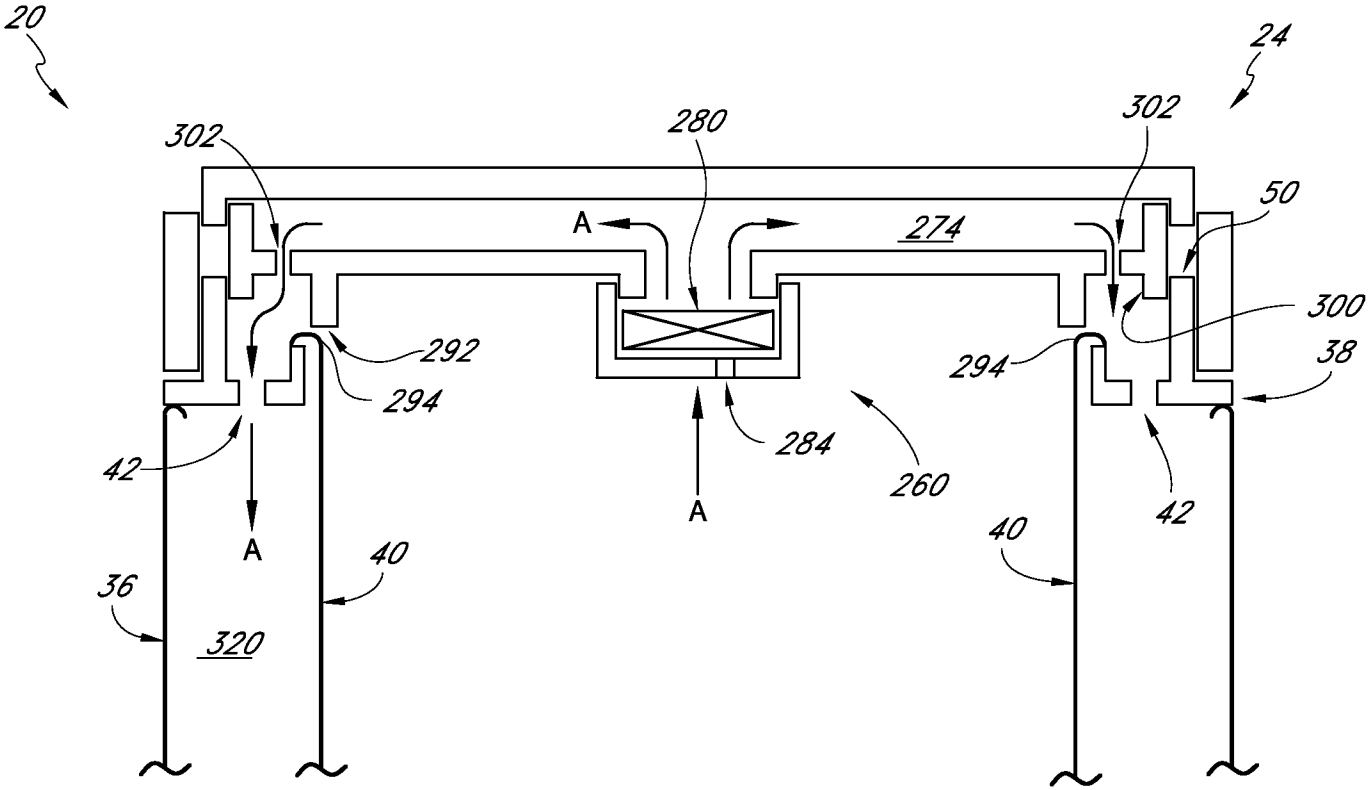
FIG. 10 is a further schematic illustration of the air filtration device illustrated in FIG. 9, showing the lid in a position close to a fully closed position.

With reference to FIG. 10, the trashcan assembly 20 can be configured to use this momentary pulse of air to help guide air through the filtration device 260.

For example, as illustrated in FIG. 10, as the lid 24 approaches its closed position, the shoulder 292 of the air guide comes into close proximity and/or into contact with the upper inner peripheral surface 294 of the liner 40. Thus, air A within the liner 40 is trapped except for the apertures 284. Thus, as the pressure within the liner 40 rises during this downward movement of the lid 24, air A, due to its positive pressurization within the liner 40, is pushed through the apertures 284, and through the filter element 280 into the space 274. As such, the odors from the air can be removed by the filter element 280.

As noted above, the air guide 264 also includes apertures 302 disposed outwardly from the shoulder 292. Thus, the air A flowing through the apertures 284 and the filter member 280 can continue to flow through the space 274 and out of the space 274 through the apertures 302.

In some embodiments, a trashcan assembly 20 can be configured to allow the air passing through the apertures 302 to be discharged directly to the atmosphere. For example, the shoulder 300 can be provided with apertures.

However, further advantages can be achieved if the air filtration device 260 is configured to guide the air which has moved through the filter element 280 into a further interior compartment of the trashcan assembly 20, for example, between the shell 36 and the liner 40.

As noted above, the lower outer peripheral shoulder 300 of the air guide 264 can be configured to move into close proximity and/or contact with the upwardly standing wall 50 of the upper support 38. As such, as the lid 24 moves downwardly toward its closed position, the shoulder 300 can form a seal and/or an area of higher resistance to airflow. As such, air A flowing through the space 274 can exit the space 274 through the aperture 302, and then apertures 42 disposed in the upper support member 38 (described above with reference to FIG. 1).

The space between the shell 36 and the liner 40, identified by the reference numeral 320, can be open to the atmosphere. For example, this space 320 can be open to the atmosphere through various holes in the base 26. For example, the base 26 can include a plurality of various holes and apertures in the support plate 38 (as illustrated in FIG. 2). Additionally, the shell 36 can include an aperture 321 (FIG. 2) configured to perform as a handle for carrying the trashcan 20, and/or other apertures can also be provided.

Thus, as the lid 24 closes, air A can be pumped from the interior of the liner 40, through the filter element 280, and into the space 274, and the air A can be further pumped or urged downwardly into the interior of the trashcan assembly 20, such as the space 320 between the liner 40 and the shell 36. This can provide a further advantage in that the user experiences a smaller or no puff of air as the lid 24 closes. Additionally, if the user has not inserted a filter element 280 into air filtration device 260, or if the air filter element 280 has exceeded its useful lifespan, and can no longer remove odors from the air A, the user is not subjected to a puff of air filled with trash odors. Rather, this odor filled air is pumped downwardly into the interior of the trashcan and leaks out in various places near the base or other apertures. Thus, even when the air filtration device does not filter any odors from the air, it directs the "puff" of air into the interior of the body 22, thereby deflecting at least some of that flow of air away from the user.

FIGS. 1, 2, 11 and 12 illustrate a modification of the air filtration device illustrated in FIGS. 9 and 10. Thus, the air filtration device illustrated in FIGS. 11 and 12, along with its components corresponding to that of FIGS. 9 and 10, are identified with the same reference numerals except that a letter "A" has been added thereto. Thus, the construction and operation, and effects of the components described above apply to the device 260A described below, except as specifically noted below.

Figure 11:
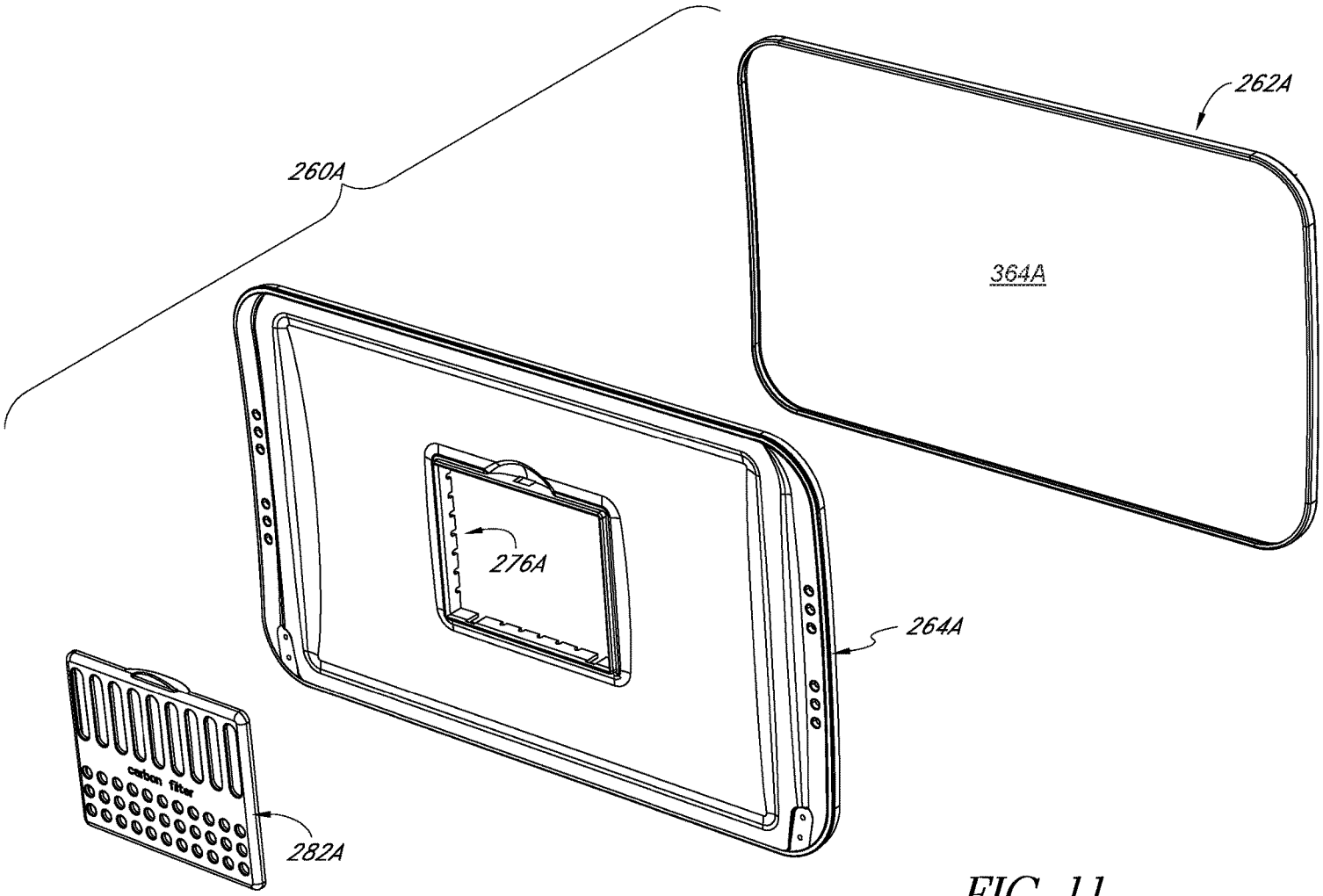
FIG. 11 is an exploded view of another embodiment of the air filtration device illustrated in FIGS. 9 and 10.

As shown in FIG. 11, the cover 282A includes an upper peripheral edge 360, having an outer dimension that is smaller than inner dimension of the aperture 276A of the air guide 264A. As such, the cover 282A generally fits within the aperture 276A.

Figure 12:
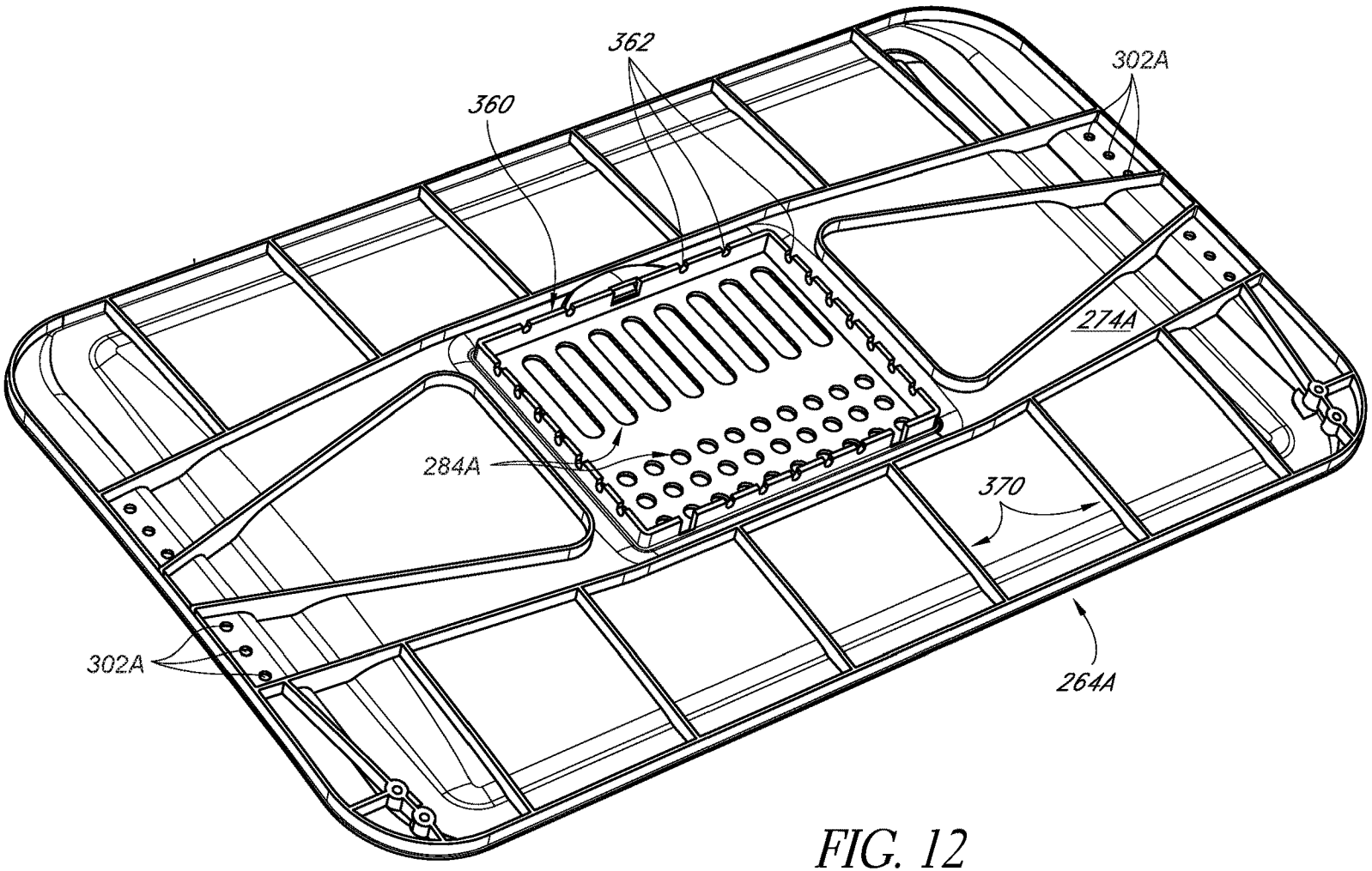
FIG. 12 is a perspective view of an inner surface of a portion of the air filtration mechanism illustrated in FIGS. 9 and 10.

With reference to FIG. 12, the edge 360 can include a plurality of apertures or notches 362. As such, when the cover 282A is inserted into the aperture 276A, it may make contact with an inner surface 364A of the outer lid member 262A. Thus, the notches 362 allow air to flow outwardly into the space 274A even if the cover 282A makes contact with the inner surface 364A. Other configurations can also be used. For example, the notches 362 can be provided in a wall fixed to the air guide 264 and the removable portion of the cover can attach to a periphery of the aperture 276A. The cover 282A filter can include one or more apertures 284A configured to allow air to move from the exterior into the interior of the cover 282A.

Additionally, with continued reference to FIG. 12, the air guide 264A can include a plurality of stiffening ribs 370 extending from the outer peripheral shoulder 272 inwardly toward the aperture 276A. This provides an additional benefit in that when the lid is closed and air is pumped into the space 274A, the surface of the air guide 264A surrounding the aperture 276A can be subjected to forces that would tend to deflect the surface of the air guide 264A due to the positive pressure within the liner 40. Similarly, as the lid 24 is opened, a slight vacuum can be created within the liner 40, thereby causing the surfaces of the air guide 264A surrounding the aperture 276A to tend to deflect toward the interior of the liner 40. These movements of the surfaces can cause failures and/or noises within the trashcan assembly 20A. Thus, the stiffening ribs 370 help reduce or prevent such noises or failures. As noted above, the air guide 264A can include apertures 302A.

Figure 13:
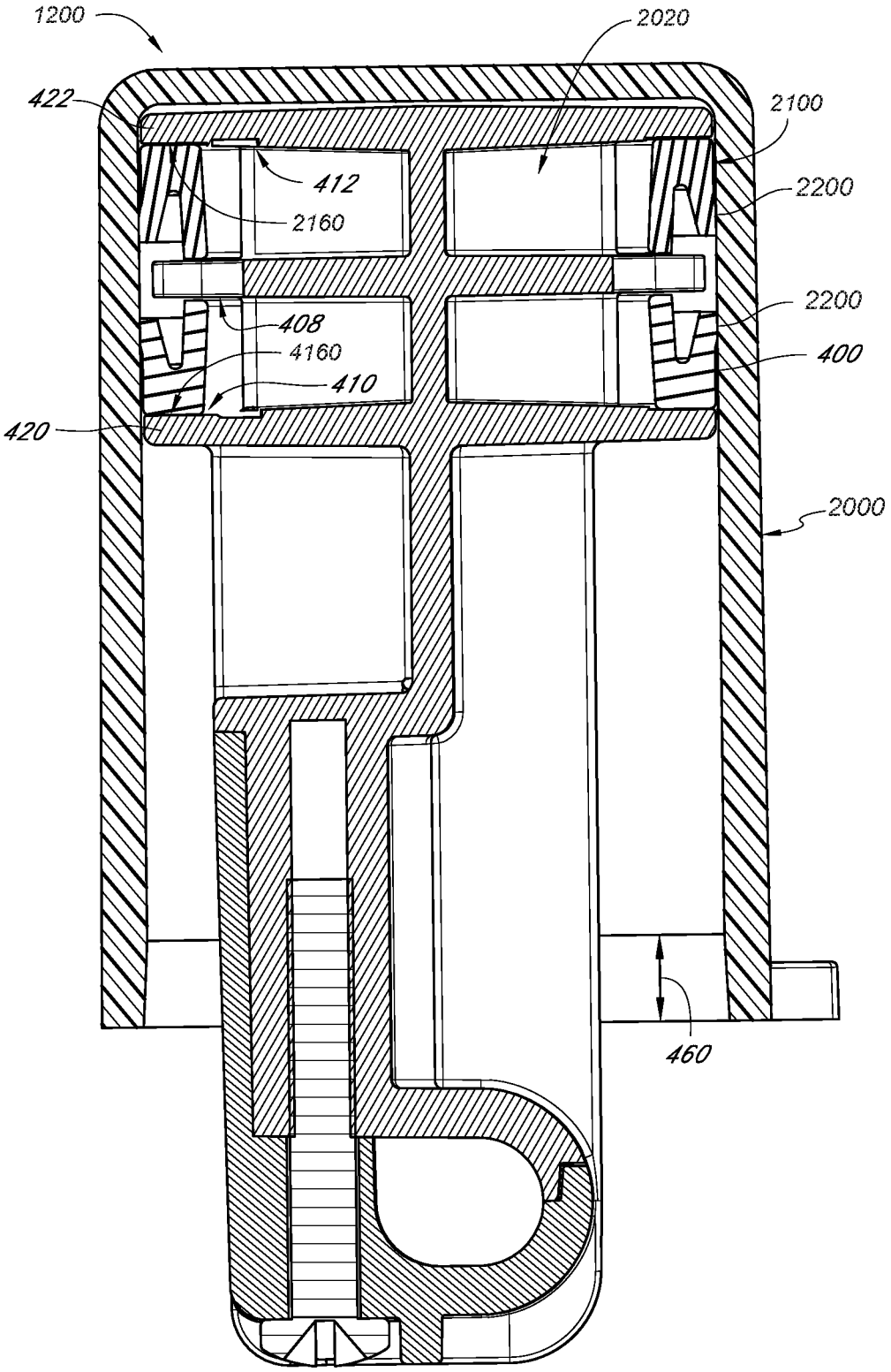
FIG. 13 is a sectional view of a modification of the air damper mechanism of FIG. 5.
Figure 14:
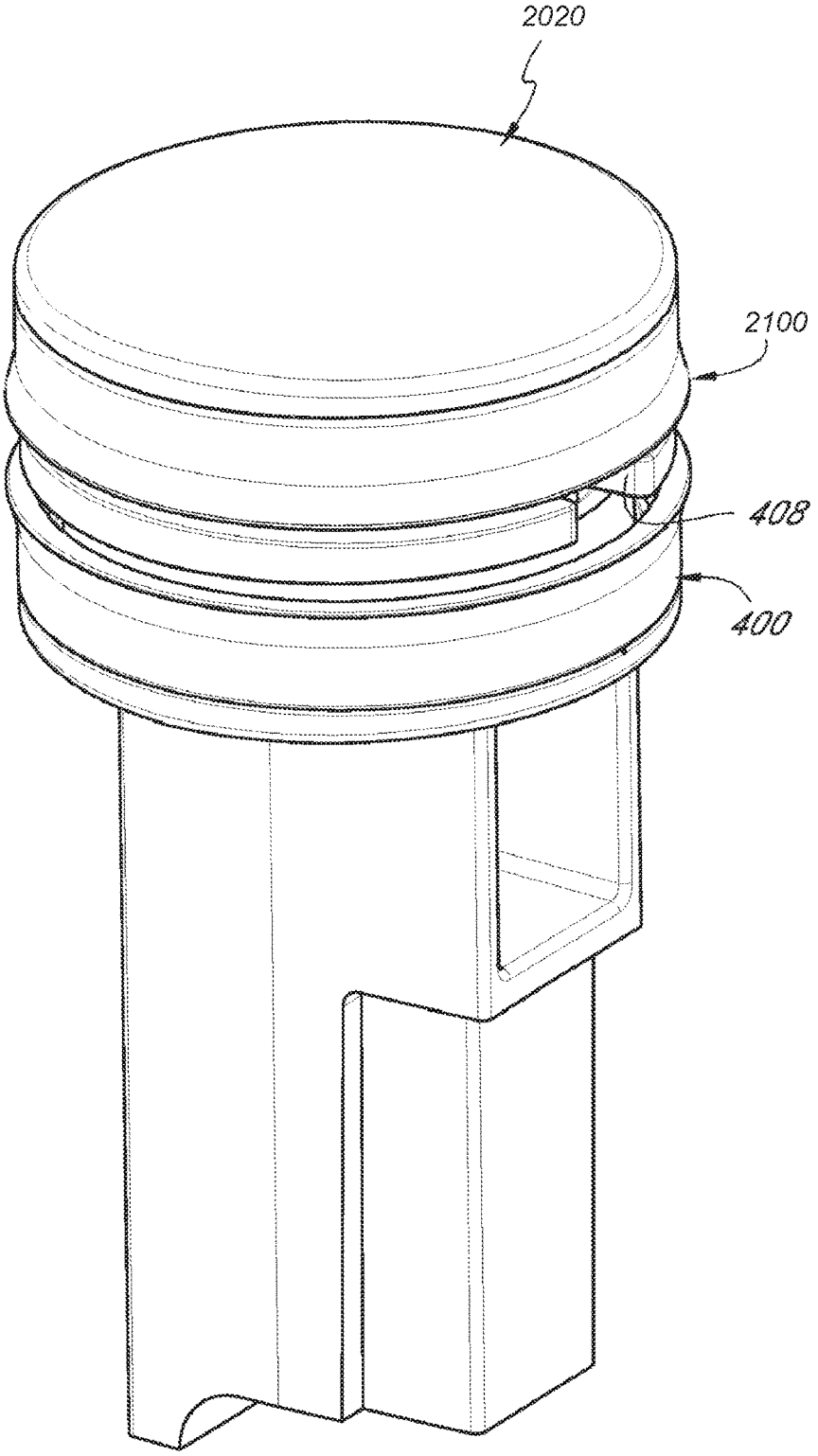
FIG. 14 is an illustration of a piston of the air damper mechanism of FIG. 13.
Figure 15:
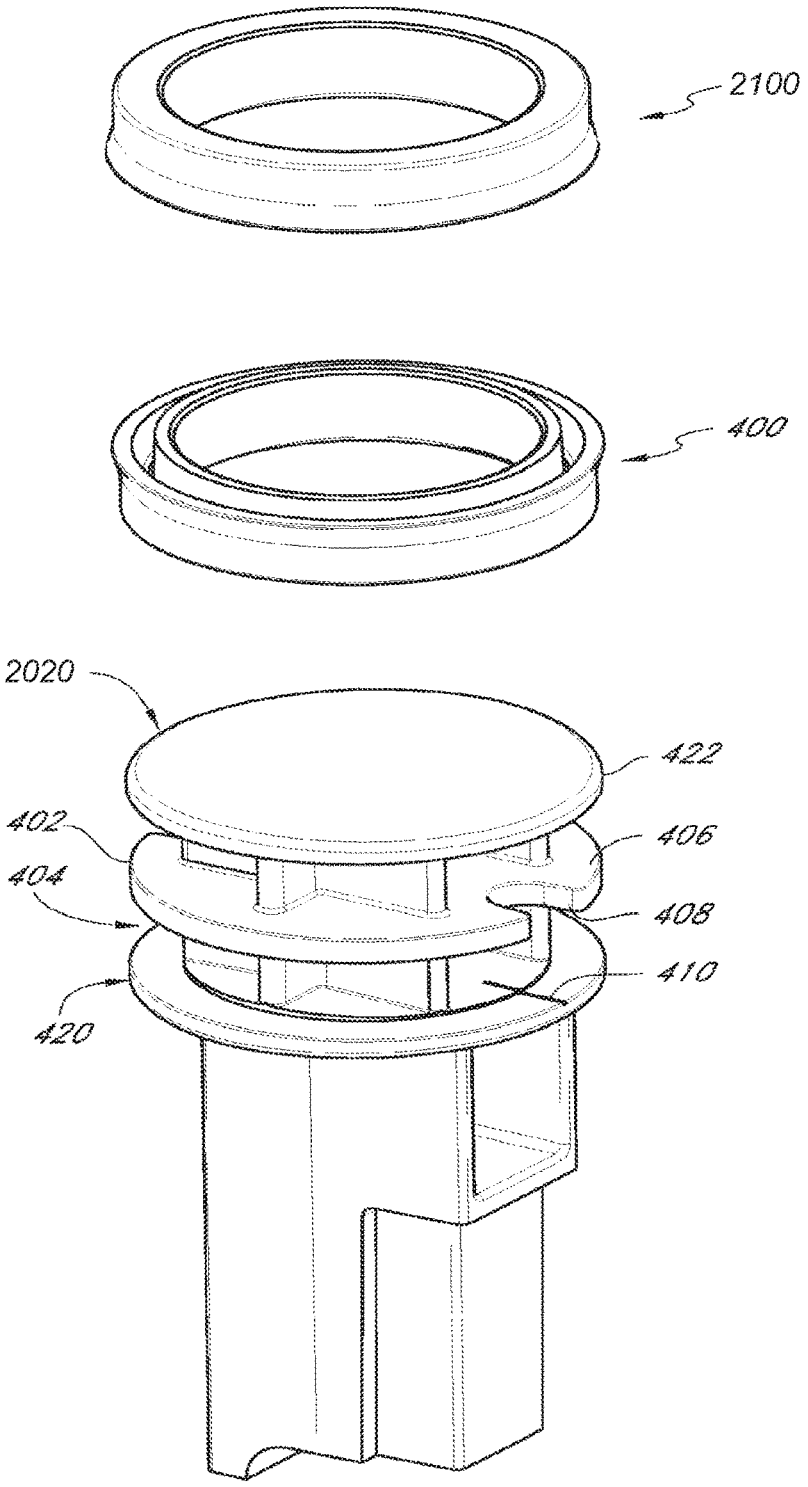
FIG. 15 is an exploded view of the piston of FIG. 14.

With reference to FIGS. 13-15, the trashcan receptacle 20 can be provided with at least one dampening mechanism configured to provide dampening against the movement of the lid 24 in both the opening and closing directions. Such a dampening mechanism can be constructed in any known manner. By providing dampening in both the opening and closing directions, the trashcan 20 can avoid certain additional undesirable noises and/or damage.

For example, a user may intentionally or accidentally step on the pedal 32 with significantly more force than necessary to open a lid 24. This can cause a lid 24 to open at a great speed, and thereby raise the possibility that the lid 24 impacts a wall or another nearby body. Such an impact can cause a large noise. Additionally, such a movement of the lid 24 can damage the hinge mechanism connecting lid 24 to the body 22.

The dampening mechanism 1200 illustrated in FIGS. 13-15 is a modification of the dampening mechanisms 120, 122 described above with reference to FIGS. 2 and 5-8. Thus, the dampening mechanism 1200 of FIGS. 13-15 is identified by the same reference numeral, except that a capital letter "A" has been added thereto. Thus, the corresponding components can be constructed and operated in the same way as described above, except as specifically described below.

As illustrated in FIGS. 13 and 14, the dampening mechanism 120A includes two lip seals 210A and 400. The lip seal 400 can be constructed in the same manner as lip seal 210A. In other embodiments, the lip seal 400 can be different from the lip seal 210A, for example, if it is desired to provide different dampening performance against the upward motion of the piston than the downward motion of the piston. However, for convenience, the same reference numerals used to identify various parts of the lip seal 210A are used to identify the same or similar parts of the lip seal 400. Thus the configuration of the lip seal 400 can be the same or similar to the lip seal 210A, except as noted below.

With reference to FIGS. 14 and 15, the piston 2020 includes two peripheral grooves 402, 404 sized and shaped to retain the lip seals 21 OA, 400, respectively. A disk-shaped wall 406 can be disposed between the grooves 402, 404, and thus between the lip seals 21 OA, 400. As illustrated in FIG. 15, the disk 406 includes a large aperture 408, which allows for airflow between the lip seals 21 OA, 400, described in greater detail below.

With such a configuration, as noted above, the lip seal 21 OA resists the downward movement of the piston 2020 while the second lip seal 400 resists the upward movement of the piston 2020. As noted above, with regard to this description of the lip seal 210, the various parts of the lip seals 21 OA, 400, the lubrication used, etc., can be adjusted to provide the desired dampening characteristics.

Further advantages, including greater consistency in performance, can be achieved by providing the dampening mechanism 1200 with at least one metering channel 410, 412, to allow air to leak around at least one of the lip seals 21 OA, 400.

For example, with reference to FIG. 15, the piston 2020 includes a lower wall 420 cooperating with the central disk 406 to define the channel 404. Additionally, the piston 2020 includes an upper wall 422 cooperating with the disk 406 to define the channel 402. However, other configurations can also be used.

As shown in FIG. 13, the upper wall 2160 of the lip seal 21 OA rests against the downwardly facing surface of the upper wall 422. Similarly, the upper wall 2160 of the lip seal 400 rests against the upwardly facing wall of the lower wall 420. Across the contact patch between the upper wall 2160 and the downwardly facing surface of the upper wall 422, the metering channel 412 extends so as to allow airflow between the exterior of the piston, and the space above the top of the piston 2020 and the interior of the piston 2020. Similarly, the metering channel 410 allows the flow of air from the exterior of the piston, beneath the upper wall 4160, of the lip seal 400, and into the interior of the piston.

Additionally, as noted above, the central disk 406 includes an aperture or notch 408 thus, air can leak from the atmosphere, beneath the wall 2160 of the lip seal 400, into the interior of the piston, upwardly through the notch 408, into the metering channel 412, then outwardly above the wall 2160 of the lip seal 21 OA, and into the space within the housing 2000 above the top of the piston 2020. As such, the metering channels 410,412 can limit the amount of dampening generated by the lip seals 21 OA, 400.

In an exemplary but nonlimiting embodiment, the housing 2000 can be made from a material commercially available under the trade name Acetal Oelrin with 10% Teflon added. The piston 2020 can also be made from the material known as Acetal Oelrin. Further, the lip seal 21 OA, 400 can be made from graphite impregnated nitrile. Other materials can also be used.

Further, in some examples, the metering channels 410, 412 can have a width of approximately 0.15 mm and a depth of approximately 0.15 mm. Additionally, depending on the performance desired, a plurality of metering channels 410, 412, can be provided on each of the walls 420, 422.

Additional advantages can be achieved by providing the dampening mechanism 1200 with the ability to provide variable dampening in at least one of its directions of movement. For example, when a user initially steps on the pedal 32 of the trashcan assembly 20, the lip seal 400 will oppose the upward movement of the piston 2020 within the housing 2000 due to its inverted orientation relative to the lip seal 21 OA. This will help prevent an excessively fast opening speed of the lid 24.

In some circumstances, the movement of the damper piston 2020 inside the damper housing 2000 may make groaning or squeaking noises, especially after a certain number of movement of the damper piston 2020, as the seals 21 OA and 400 of the damper piston 2020 rub against the surface of the damper housing 12. Without much lubrication between the seals 21 OA and 400, which are generally made of rubbery material, and the damper housing 2000, which is generally made of plastic material, the movement of the piston 2020 can cause groaning noises and be subject to frictional wear and rubbing. For example, groaning may start after from about 5000 to about 40,000 steps of the trash can pedal or movement of the damper piston 2020. In contrast, one embodiment that employed a textured interior surface for damper housing 2000 was able to improve the onset of groaning to about 150,000 cycles or steps.

In some embodiments, the damper housing 2000 is provided lubrication for the movement of the piston 2020 for less friction and substantially noise-less movement. For example, the lubrication may comprise a variety of lubricants alone or in combination, such as graphite powder, silicone grease, oils, and the like. Any type of lubricant may be employed in the embodiments.

Additionally, the damper housing 2000 may be constructed from various materials to reduce frictional wear and increase the number of steps (movements), for example, beyond 40000 steps until groaning noises commence. In some embodiments, the damper housing 12 can be infused with Teflon®, Duracon YF-10, and graphite powder to improve the lubrication between the seals 21 OA and 400 of the damper piston 2020 against the damper housing 2000. The percentage of the graphite powder can be about 5% of the damper housing content. In some embodiments, the graphite powder can be about 2 microns in diameter.

In some embodiments, the damper housing 2000 may be infused with a foam material infused with or containing graphite powder in the inner top portion. The size of the foam can be fitted inside the damper housing 2000, such as about 30 mm in diameter and about 5 mm thick. In addition, the foam can be saturated with a lubricant, such as a graphite powder, so that the lubricant disperses or trickles down each time the damper piston 2020 is actuated by the pedal of the trashcan.

In some embodiments, the housing 12 can be designed to have a surface to prevent audible groaning sounds during operating. Groaning may be caused due to rubbing of the damper housing 2000 and the damper piston 2020. Such groaning may occur after use, such as after about 40000 steps. It may be desirable to prevent or reduce groaning sounds.

The interior surface of damper housing 2000 may be modified to deaden or dampen groaning sounds. In particular, the interior surface of the damper housing 2000 may be textured or patterned. For example, the surface of the housing 12 may have a roughened surface or other surface features. Exemplary surface features may include dimples, ridges, grooves, and the like. These surface features may be concave, i.e., extending from the surface or convex or indentions, i.e., extending inward towards the surface. The surface features may comprise a variety of sizes on the order of nanometers, micrometers, millimeters, or higher.

Roughening of the surface or other types of surface features may serve to dissipate the sound energy as it propagates from the housing 12 as well as dispersing sound wave reflection to dampen or eliminate groaning sounds. The surface metrology of the housing 12 may thus be configured to reduce audible groaning sounds as the damping piston 2020 moves along the interior surface.

The roughness of the surface can be achieved by various means or treatments. For example, the surface of the interior of damper housing 2000 may be sprayed with damper housing material as mentioned above. Alternatively, the damper housing 2000 can be injection molded to have a rough surface or surface pattern. In other embodiments, the surface of the damper housing 2000 may be mechanically treated, such as milling, sandblasting, etching, laser etching, or other forms of machining, to create a textured or roughened surface that prevents groaning. In other embodiments, the damper housing 2000 may also under go various chemical treatments to create surface features.

In yet other embodiments, the housing 2000 may be constructed from various combinations of materials that insulate or dampen sound energy. For example, the housing 2000 may comprise one or more layers of sound deadening material, such as foam, fiberglass, plastic, etc. Such acoustic materials may absorb the sound energy, for example from groaning sounds, and/or may reflect the sound energy. In accordance with the principles of the embodiments, the housing 2000 may be configured with various surfaces to counteract different frequencies of groaning sounds.

Further, it has been found that it can be advantageous to provide a reduced dampening force against the initial movement of the pedal 32 toward its opening position. For example, with regard to some trashcans, such as a trashcan assembly 20 illustrated in FIG. 1, due to the pivoting arrangement of the lid 24, a user must apply the most amount of force to move the pedal 32 when the lid 24 is closed, as compared to the forces required to move the pedal 32 through the remainder of its opening motion. This is because when the lid 24 is orientated in its closed position, the weight of the lid 24, acting at its center of gravity, provides the largest torque against the pivoting movement of the lid 24 towards it open position. Thus, the force required to move the pedal 32 through its initial portion of its movement toward its opening position is greatest when the lid 24 is closed.

However, in operation, as the lid 24 pivots toward its open position, the horizontal position of the center of gravity moves closer to the pivot axis, and thus, the torque generated by the weight of the lid 24 decreases proportionally. As the center of gravity of the lid 24 moves directly over the pivot axis, the torque created by the weight of the lid falls to zero. Thus, as the lid 24 pivots toward its open position, depending on the force applied to the pedal, the lid can achieve an excessive angular velocity and thus an excessive angular momentum. This can result in damage to the lid 24, a hinge connecting the lid 24 to the trashcan assembly 20, a nearby wall, or other damage.

Further, if a trashcan includes a feature, such as a filtration device, which may generate a vacuum during the initial opening movement of the lid, the force required to move the pedal 32 from its initial resting position can be even greater due to the additional weight to the filtration device. Thus, it can be advantageous to provide a dampening mechanism that can reduce the initial dampening forces applied during the initial movement of the lid toward its opening position. Such a reduction in the initial movement of a pedal can be achieved through any known device, including, for example, but without limitation, lost motion devices, the sizing and configuration of the dampening device itself, and/or other devices.

With continued reference to FIGS. 13-15, the dampening mechanism 1200 can be configured to provide a variable or changing dampening force over the range of motion of the piston 2020 relative to the housing 2000 in at least one direction.

In some embodiments, this variable dampening can be provided by providing the housing 2000 with a zone 460 having a greater inner diameter than the remainder of the housing 2000. Additionally, the housing 2000 and the connection of the piston 2020 with the member 102 can be arranged such that the outer projection 2200 of the lip seal 400 contacts the inner surface of the housing 2000 in the zone 460 when the pedal 32 is in its resting position.

For example, but without limitation, the inner diameter of a portion of the zone 460 can be sufficiently greater than the remaining inner diameter of the housing 2000, that the projection 2200 of the lip seal 400 loses contact with at least a portion of the inner surface of the zone 460. Thus, when the pedal 32 is depressed by a user, initially, the lip seal 400 generates greatly reduced or no dampening force against the upward movement of the piston 2020 within the housing 2000. In some embodiments, the increase in diameter of the inner surface of the housing 2000 in the zone 460 is gradual. Thus, as the projection 2200 of the lip seal 400 moves from the lowest portion (as viewed in FIG. 13) of the zone 460, upwardly, the projection 2200 will remain oriented in the desired position, gradually regain contact with the inner surface of the housing 2000 and generate dampening force as it leaves the zone 460.

In some embodiments, the zone 460 can have the same diameter as the other parts of the inner surface of the housing 410, and the damper 1200 can be configured to provide reduced dampening against the opening movement of the lid 24 with other techniques. For example, the overall size and/or proportions, including for example, but without limitation, the total volume of the housings 200, 400, the stroke (i.e. the total distance the pistons 202, 2020 travel within the corresponding housing), the ratio of the stroke to the diameter of the housing, the compressibility of the working fluid (e.g., air and other gasses are "compressible fluids" and most liquids are "noncompressible"), can affect the dampening provided during the initial movement of the lid 24 toward the open position. Thus, in some configurations, one of these parameters can be determined to provide the desired reduced dampening for the desired portion of the initial movement of the lid 24 toward its open position.

As with the other dimensions of the housing 2000 and the lip seal 21 OA, 400, the configuration and length of the zone 460 can be adjusted to provide the desired dampening characteristics.

Although these embodiments have been disclosed in the context of certain preferred embodiments and examples, it will be understood by those skilled in the art that the present embodiments extend beyond the specifically disclosed embodiments to other alternative embodiments and/or uses of the embodiments and obvious modifications and equivalents thereof In addition, while several variations of the embodiments have been shown and described in detail, other modifications, which are within the scope of these embodiments, will be readily apparent to those of skill in the art based upon this disclosure. It is also contemplated that various combinations or sub-combinations of the specific features and aspects of the embodiments can be made and still fall within the scope of the embodiments. It should be understood that various features and aspects of the disclosed embodiments can be combined with or substituted for one another in order to form varying modes of the disclosed embodiments. Thus, it is intended that the scope of at least some of the present embodiments herein disclosed should not be limited by the particular disclosed embodiments described above.

What is claimed is:

1. A trash receptacle configured to reduce audible noises during operation, said trash receptacle comprising:

a body having an open top portion;

a lid, coupled to the body, configured to pivotably move between an open position and a closed position relative to the body;

an actuator, coupled to the lid, configured to move the lid via a linkage connected to the lid, wherein the linkage moves in response to an applied force; and a dampening device comprising:

a movable component coupled to the linkage;

a graphite powder lubricant; and a housing having an interior surface having at least one roughening surface feature, wherein the housing is infused with a foam material that disperses a lubricant when the movable component is actuated by the linkage, wherein the lubricant comprises a graphite powder, wherein the foam material is saturated with the lubricant, and wherein the lubricant trickles downward each time the dampening device is actuated, and wherein at least a portion of the movable component slides against the at least one roughening feature when the lid pivots between the open and the closed positions, the at least one roughening feature configured to reduce audible noise generated by the movable component sliding against the housing.

2. The trash receptacle of claim 1, wherein the dampening device comprises the housing and a piston and wherein the piston is coupled to the actuator.

3. The trash receptacle of claim 1, wherein the dampening device comprises one or more layers of a sound deadening material.

4. The trash receptacle of claim 1, wherein the dampening device is infused with polytetrafluoroethylene.

5. The trash receptacle of claim 1, wherein the dampening device is infused with a polyplastic.

6. The trash receptacle of claim 1, wherein the dampening device is configured to require a threshold amount of force applied by the actuator to open the lid when the lid is in the closed position.

7. The trash receptacle of claim 1, wherein the actuator comprises a pedal at a bottom portion of the body.

8. The trash receptacle of claim 1, wherein the at least one roughening surface feature comprises dimples.

9. The trash receptacle of claim 1, wherein the at least one roughening surface feature comprises ridges.

10. The trash receptacle of claim 1, wherein the at least one roughening surface feature comprises grooves.

11. The trash receptacle of claim 1, wherein, when the lid pivots between the open and the closed positions, air passes between the movable component and the interior surface of the housing.

12. The trash receptacle of claim 11, wherein the dampening device is configured to adapt for the compressibility of the air during movement of the lid toward the open position.

13. The trash receptacle of claim 1, wherein the interior surface having the at least one roughening surface feature further comprises graphite powder.

14. The trash receptacle of claim 13, wherein the graphite powder has a diameter of about 2 microns.

15. The trash receptacle of claim 1, wherein the moveable portion of the dampening device and the roughening feature of the interior surface of the housing are configured to slide against each other when the lid pivots between the open and the closed positions for more than 40,000 iterations before the onset of audible groaning or squeaking noises.

16. The trash receptacle of claim 1, wherein, when the movable component slides against the at least one roughening feature of the housing, the movable component substantially maintains its rotational position relative to the housing.

17. The trash receptacle of claim 1, further comprising a lip seal coupled to the movable component, the lip seal comprising a projecting portion that is biased to extend radially outwardly, wherein:

when the movable component moves into the housing, a pressure generated in a space above the movable component deflects the projecting portion radially inwardly; and when the movable component moves outward from the housing, the pressure in the space drops relative to the pressure of the atmosphere, thereby causing the projecting portion to further expand against an inner wall of the housing.

* * * * *